US006088986A

United States Patent [19]

DiGate

[11] Patent Number: 6,088,986

[45] Date of Patent: Jul. 18, 2000

[54] WALLBOARD REPAIR CLIP, METHOD OF REPAIRING WALLBOARD, KIT FOR REPAIRING WALLBOARD, AND METHOD OF ACCESSING THE INTERIOR OF HOLLOW WALLS

[75] Inventor: John T. DiGate, Westminster, Md.

[73] Assignee: Jeffrey S. Melcher, Bethesda, Md.

[21] Appl. No.: 09/231,775

[22] Filed: Jan. 15, 1999

Related U.S. Application Data

[63] Continuation-in-part of application No. 09/168,887, Oct. 9, 1998.

[51] Int. Cl.[7] ..... E04G 23/02

[52] U.S. Cl. ..... 52/514; 52/584.1; 52/712; 52/745.19; 52/745.2

[58] Field of Search ..... 52/514, 584.1, 52/712, 745.19, 745.2

[56] References Cited

U.S. PATENT DOCUMENTS

| | | | |
|---|---|---|---|
| D. 391,149 | 2/1998 | Gonzales . | |
| 924,355 | 6/1909 | Howard | 52/712 |
| 3,995,404 | 12/1976 | Thaw . | |
| 4,152,877 | 5/1979 | Green . | |
| 4,578,854 | 4/1986 | Demeglio . | |
| 4,641,474 | 2/1987 | Cannarsa . | |
| 4,644,723 | 2/1987 | Weber . | |
| 4,782,642 | 11/1988 | Conville . | |
| 4,831,808 | 5/1989 | Wynar . | |
| 4,995,605 | 2/1991 | Conville . | |
| 5,653,079 | 8/1997 | Loeffler et al. | 52/712 |
| 5,687,528 | 11/1997 | Rouch . | |

*Primary Examiner*—Christopher T. Kent
*Attorney, Agent, or Firm*—Jeffrey S. Melcher

[57] ABSTRACT

Provided is a wallboard repair clip which includes a patch wallboard receiving structure for contacting inner and outer surfaces of a patch wallboard, an existing wallboard receiving member and a locking structure. The locking structure and existing wallboard receiving structure are constructed such that inner and outer surfaces of the existing wallboard are contacted once the patch wallboard is in a repaired position within the existing wallboard.

63 Claims, 16 Drawing Sheets

WALLBOARD REPAIR CLIP, METHOD OF REPAIRING WALLBOARD, KIT FOR REPAIRING WALLBOARD, AND METHOD OF ACCESSING THE INTERIOR OF HOLLOW WALLS

This application is a Continuation-in-Part of U.S. Ser. No. 09/168,887 filed on Oct. 9, 1998, the complete disclosure of which is incorporated herein by reference.

FIELD OF THE INVENTION

This invention relates to a clip for repairing a hole in wallboard. The invention also relates to a method of repairing a hole in wallboard. The invention further relates a kit for repairing a hole in wallboard. The invention also relates to a method of accessing the interior of a hollow wall.

BACKGROUND OF THE INVENTION

It is generally known that modern day building construction techniques have been increasingly directed toward the use of wallboard panels to construct walls and partitions. The wallboard materials generally used are commonly referred to as drywall, gypsum board, plasterboard, wood paneling, and the like. The wallboards are usually connected to studs which are suitably spaced according to local building codes.

While the construction techniques of such hollow walls has provided advantages, they also have many disadvantages with respect to repairing holes. When patching a hole in the existing wallboard, the wallboard is cutout around the damage, and patch wallboard is inserted and the seams plastered over. Often, the hole is between the studs leaving nothing to keep the patch wallboard flush with the existing wallboard. A common method is to cut and remove a large section of the existing wallboard extending from stud to stud, and securing a patch wallboard to the studs. While this method facilitates a repair of the damaged wallboard, it nevertheless is expensive and wasteful. In addition, the nature of such a repair requires that the patch wallboard be of a thickness identical to that of the existing wallboard so as to provide a continuous surface at the periphery of the repair. Also, since some types of wallboard such as drywall are not constructed to withstand substantial bending forces, the flexing of the wallboard repair panel between the studs presents a problem due to the absence of structural supports within the span. In most applications, since the stud-to-stud distance is approximately 16 inches, this problem of patch wallboard can cause problems of discontinuity at the surfaces between the patch wallboard and the surrounding wallboard portions.

Several other methods have been used to hold the patch wallboard flush with the existing wallboard while applying the plaster. Another method is to cut a patch wallboard using drywall such that a flap of the paper is left around the edges. The patch wallboard is inserted in the hole and the paper flap is then plastered over. This method undesirably requires a significant amount of precise cutting and plastering over the paper flap is difficult. A further method involves mechanically fastening a fastener behind the hole to back the patch wallboard, which is time consuming, difficult to precisely align the backing, and requires that the patch wallboard be of the same thickness as the existing wallboard. There are also commercially available screens to use in the patching the wallboard.

Several attempts have been made to overcome these disadvantages. U.S. Pat. No. 3,995,404 discloses a clip for repairing drywall. The clip is mounted on the sides of the hole in the drywall being repaired by wallboard gripping members 18 and 20. The patch wallboard is then pushed into the hole being repaired. The patch is held in place by a retaining member 24 which digs into the plaster between the paper surfaces of the drywall and retaining member 22. The outer paper surface of the drywall patch is not contacted with a surface of the clip. Since some wallboard materials are brittle, such as plasterboard, gypsum board and drywall, the retaining member 24 can easily destroy the brittle material during application and cause an unsightly bump or protrusion on the surface of the patch wallboard. Furthermore, the retaining member 24 often does not provide a secure grip since the thickness between the outer surface of the wallboard at retaining member 22 and the wallboard material at the location where the retaining member 24 contacts is significantly thinner than the total thickness of the patch wallboard. Thus, the thinner material can easily give way and allow the patch wallboard to move in relation to the existing wallboard. Furthermore, some wallboard materials are rigid, such as wood paneling, in which the retaining member 22 will not be able to penetrate.

Design Patent No. 391,149 (Gonzales) discloses a clip for repairing drywall or gypsum wallboard. This clip has a prong which digs into the material between the paper surfaces. Only one side of the paper surface is contacted on both the patch board and the mounted wall board being repaired. Since the wallboard material is often brittle, the prong often causes unsightly bumps or protrusions on the surface of the patch wallboard in the location where the prong is inserted. Furthermore, the patch wallboard is not secured inside of the existing wallboard in all directions by this clip.

U.S. Pat. No. 4,641,474 (Cannarsa) discloses a clip for joining wallboard. This clip retains the wallboard by using teeth which dig into the wallboard material. There is no structure for gripping opposing surfaces of the patch wallboard or opposing surfaces of the existing wallboard and therefore this clip has the same disadvantages of the clips described above.

U.S. Pat. No. 4,644,723 (Weber) discloses a wallboard clip for repairing holes in wallboard. The wallboard clip contains no structure for gripping opposing surfaces of the patch wallboard or opposing surfaces of the existing wallboard. The wallboard clip has a points 15 which embed into the wallboard material. Thus, this clip has the same disadvantages as those described above.

U.S. Pat. No. 5,687,528 discloses a patch fastener device for a plasterboard wall. The fastener device mounts to one surface of the patch plasterboard and one surface of the existing plasterboard with the use of adhesive strips. The fastener device contains no structure for gripping opposing surfaces of the patch wallboard or opposing surfaces of the existing wallboard and therefore this clip has the same disadvantages as the clips described above.

None of the conventional wallboard repair clips contact the inside and outside surfaces of the patch wallboard as well as the outside and inside surfaces of the existing wallboard being repaired to secure the patch wallboard inside the existing wallboard in all directions.

Trades persons, such as electricians and plumbers, routinely access the interior of hollow walls to make repairs or new installations. Usually, the portion of the wallboard removed to access the interior of the hollow wall is discarded as undesirable waste. Furthermore, the repair of the hole formed is difficult and time consuming using the above described conventional wallboard repair clips and methods. Therefore, there is a need for an efficient method which reduces the amount of waste material, reduces the amount of time required to repair the hole, and reduces the level of skill necessary to repair the hole.

SUMMARY OF THE INVENTION

An objective of the present invention is to provide a wallboard clip which contacts the inside and outside surfaces of the patch wallboard as well as the outside and inside surfaces of the wallboard being repaired to secure the patch wallboard to the existing wallboard.

Another objective of the present invention is to provide a method of repairing a hole in a wallboard which reduces the amount of time.

A further objective of the present invention is to provide a method of accessing the interior of a hollow wall which reduces the amount of waste material and reduces the amount of time required to repair the hole.

The above objectives and other objectives are surprisingly obtained by a wallboard clip which is designed to be mounted on the patch wallboard first, instead of the existing wallboard, to capture both the outer and inner surfaces of the patch wallboard. The wallboard clip includes a locking structure which allows the patch wallboard containing the wallboard clips to be installed and once in the repaired position moves into a locking position such that the outer and inner surfaces of the existing wallboard are captured. The wallboard clip secures the patch wallboard in the correct position with the outer surface of the patch wallboard and the existing wallboard being flush, regardless of the thickness of the patch wallboard or the existing wallboard. Thus, the wallboard clip simplifies and significantly reduces the time required to repair a hole in an existing wallboard, and provides a superior connection between the patch wallboard and existing wallboard.

The present invention provides a novel wallboard clip for securing a patch wallboard to an existing wallboard to repair the existing wallboard. The wallboard clip comprises:

patch wallboard receiving structure constructed and arranged to receive a patch wallboard so as to capture a peripheral portion of inner and outer opposing surfaces of the patch wallboard;

an existing wallboard receiving member constructed and arranged to contact of peripheral portion of an outer surface of an existing wallboard to be repaired, the existing wallboard receiving member being coupled to the patch wallboard receiving structure such that the peripheral portion of the outer surface of the patch wallboard and the peripheral portion of the outer surface of the existing wallboard are arranged substantially in a common plane when the patch wallboard is in a repaired position within the existing wallboard; and locking structure spaced from and coupled to the wallboard receiving member, the locking structure being constructed and arranged to move between a insertion position, wherein a sliding surface of the locking structure is constructed and arranged to contact and slide against an end of the existing wallboard to place the patch wallboard in the repaired position, and a locking position, wherein the sliding surface of the locking structure is in a relaxed position permitting a securing surface of the locking structure to contact a peripheral portion of an inner surface of the existing wallboard that is opposed to the peripheral portion of the outer surface of the existing wallboard thereby capturing the peripheral portions of inner and outer surfaces of the existing wallboard when the patchboard is in the repaired position.

Also provided is a novel method of making a wallboard clip for securing a patch wallboard to an existing wallboard to repair the existing wallboard. The method comprises:

a) providing a metal strip having opposing first and second ends, opposing first and second surfaces, and an axis along the length of the metal strip;

b) cutting the first end of the metal strip substantially in a direction of the axis to form first and third gripping members;

c) bending the first gripping member in a first direction to form about a 90° angle or less in relation to the axis;

d) bending the third gripping member in a second direction substantially opposite to the first direction to form about a 90° angle or less in relation to the axis such that inner surfaces of the first and third gripping members form about a 180° angle or less, wherein a body member being defined by a portion of the metal strip contacting the first and second gripping members;

e) bending the metal strip about 90° in relation to the axis in the first direction at an end of the body member to provide a second gripping member;

f) bending the metal strip towards the axis at an end of the second gripping member to provide a support;

g) bending the metal strip at an end of the support towards the axis to provide a sliding surface which is constructed and arranged to contact and slide along an edge of an existing wallboard during installation of the patch wallboard into the existing wallboard; and h) bending the metal strip at an end of the sliding surface in the first direction thereby defining a fourth gripping member, wherein a distance between an inner surface of the first gripping member and an inner surface of the second gripping member is about the thickness of a patch wallboard such that the inner surfaces of the first and second gripping members are capable of capturing a peripheral portion of the inner and outer surfaces of the patch wallboard, and wherein a distance between an inner surface of the fourth gripping member and an inner surface of the third gripping member is about the thickness of the existing wallboard such that the inner surfaces of the third and fourth gripping members are capable of capturing a peripheral portion of inner and outer surfaces of the existing wallboard when the patch wallboard is in a repaired position.

The present invention also provides a novel method of repairing a hole in an existing wallboard. The method comprises:

a) providing a patch wallboard having a surface area larger than a hole to be repaired in the existing wallboard;

b) tracing an outline of the patch wallboard on the existing wallboard which surrounds the hole to be repaired;

c) cutting out the trace on the existing wallboard;

d) inserting at least two of the wallboard clips onto the patch wallboard such that peripheral portions of the inner an outer surfaces of the patch wallboard are captured by the patch wallboard receiving structure; and e) inserting the patch wallboard containing the wallboard clips into the hole until the patch wallboard reaches a repaired position in which peripheral portions of the inner and outer surfaces of the existing wallboard are captured by the locking structure and the existing wallboard receiving structure.

The present invention further provides a novel method of accessing the interior of a hollow wall comprising:

cutting a hole in an existing wallboard, wherein a patch wallboard is defined by the cut;

removing the patch wallboard from the existing wallboard;

applying a plurality of wallboard clips to peripheral portions of the patch wallboard; and inserting the patch wallboard containing wallboard clips into the hole such that the wallboard clips secure the patch wallboard within the existing wallboard.

The present invention also provides a patch wallboard for repairing a hole in existing wallboard comprising:

a patch wallboard; and a plurality of wallboard clips mounted around a periphery of the patch wallboard. The wallboard clips are constructed and arranged to capture inner and outer peripheral portions of an existing wallboard when the patch wallboard is in a repaired position within the existing wallboard.

The present invention has the advantage that any size hole can easily be repaired. As the size the patch wallboard and hole increase, the number of wallboard clips or size of the wallboard clips can be increased. Generally, the greater the size of the patch wallboard and hole, the greater the number of wallboard clips required. Furthermore, the present invention is capable of providing the original fire wall protection by replacing the original existing wallboard and using a non-flammable material for forming the wallboard clip.

DETAILED DESCRIPTION OF INVENTION

Figure 1:
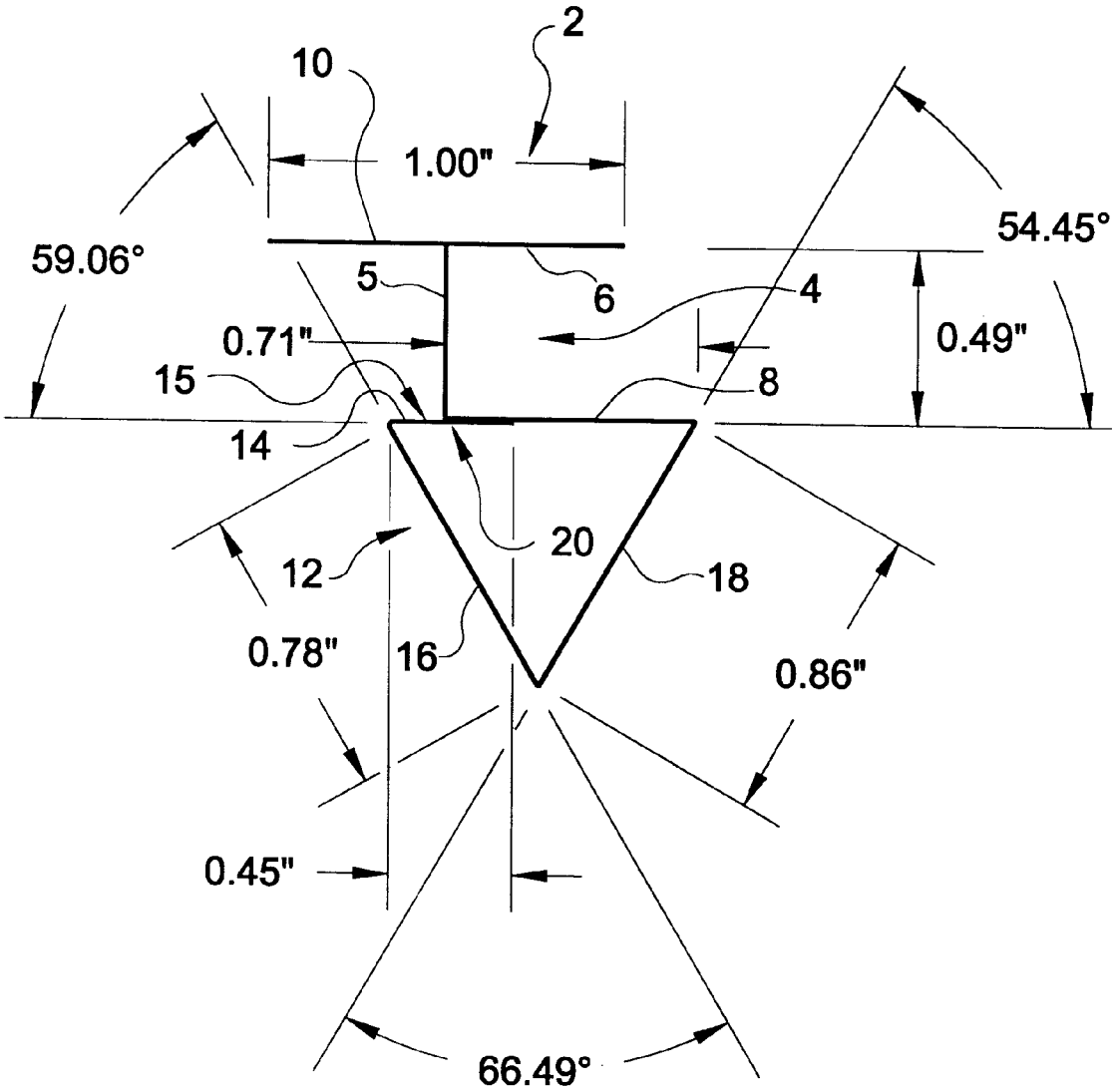
FIG. 1 illustrates a side view of a wallboard clip according to the present invention.
Figure 2:
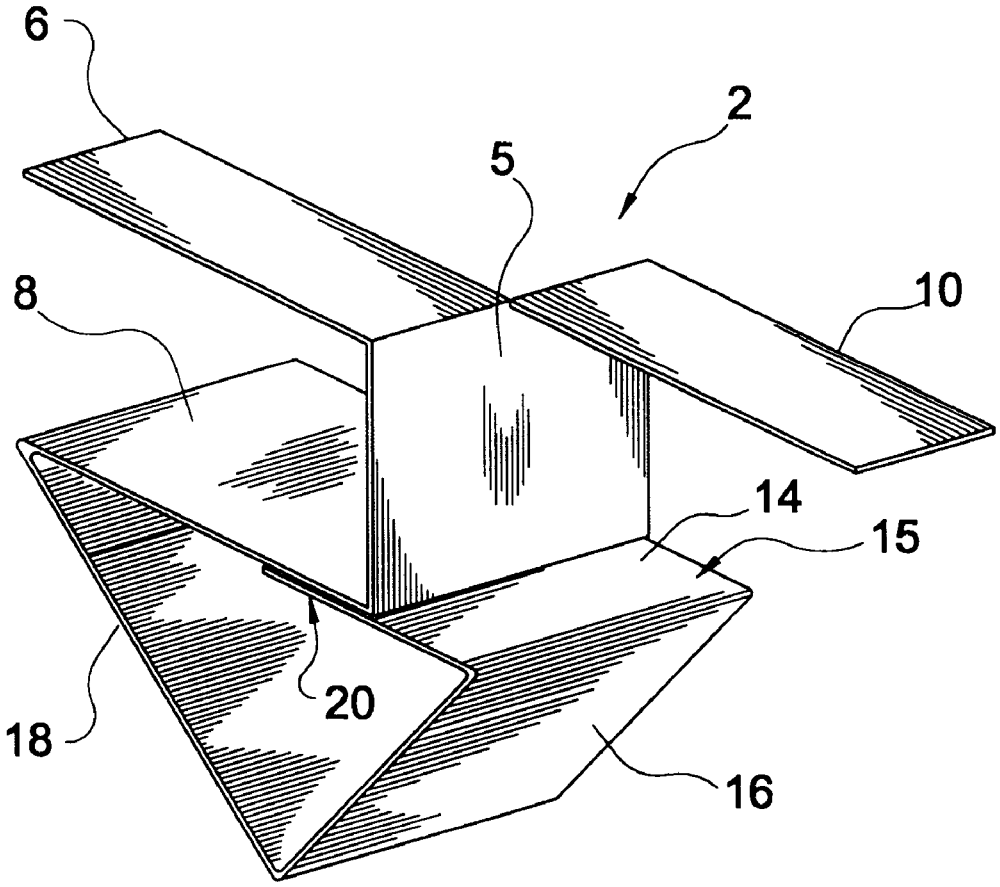
FIG. 2 illustrates perspective view of a wallboard clip according to the present invention.
Figure 20:
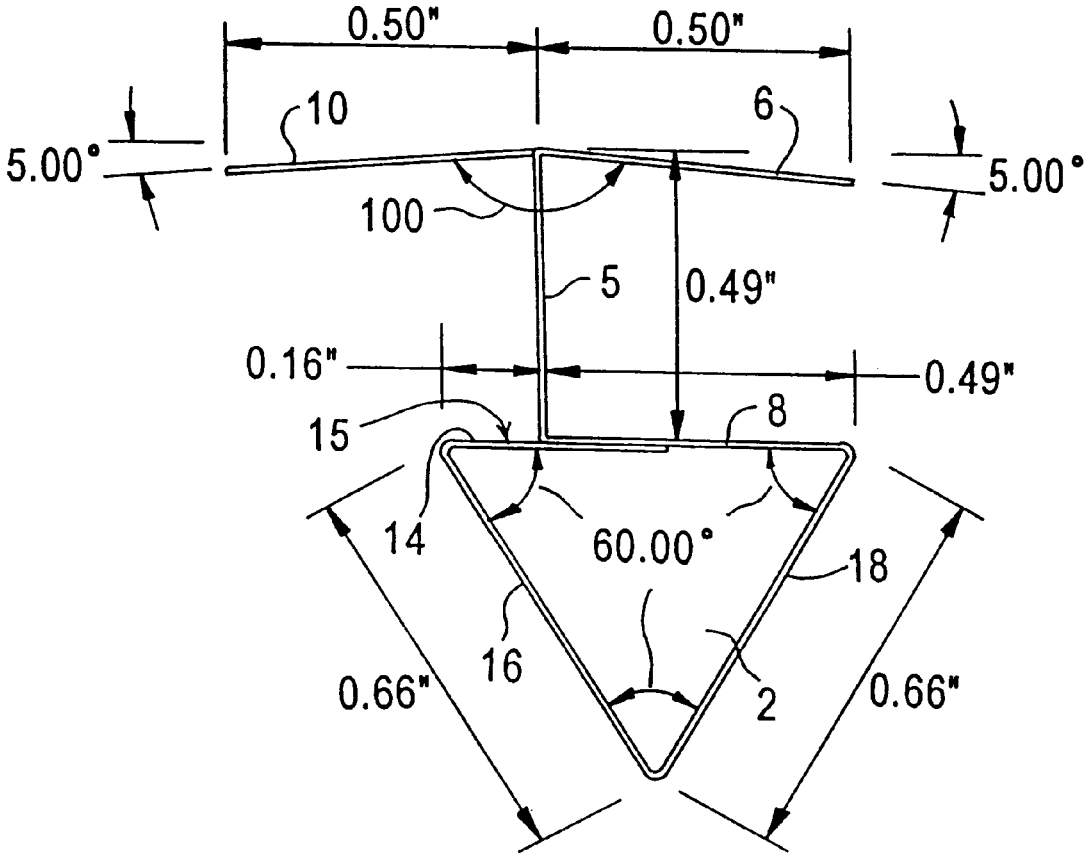
FIG. 20 illustrates a side view of a wallboard repair clip according to the present invention.

The invention will be explained with reference to the attached Figures. As shown in FIGS. 1 through 7 and 20, the wallboard clip 2 includes a body member 5. A patch wallboard receiving structure 4 is coupled to the body member 5. The wallboard receiving structure 4 is constructed and arranged to receive a patch wallboard so as to capture a peripheral portion of the inner and outer opposing surfaces of the patch wallboard. Thus, when the wallboard clip 2 is mounted on the patch wallboard, the wallboard receiving structure 4 holds the wallboard clip 2 in place during installation and secures the patch wallboard to the existing wallboard when the patch wallboard is in the repaired position. The patch wallboard receiving structure includes a first gripping member 6 which is constructed to contact a peripheral portion of the outer surface of the patch wallboard and a second gripping member 8 which is constructed to contact the peripheral portion of the inner surface of a patch wallboard. The inner surfaces of the first gripping member 6 and the second gripping member 8 are spaced apart about the thickness of the patch wallboard. The inner surfaces of the first gripping member 6 and the second gripping member 8 can be substantially parallel as shown in FIG. 1. Alternatively, the first gripping member 6 can slope towards the second gripping member 8 as shown in FIG. 20.

An existing wallboard receiving member 10, which is also referred to as a third gripping member 10, is coupled to the body member 5 and is constructed and arranged to contact of peripheral portion of an outer surface of the existing wallboard to be repaired. The existing wallboard receiving member 10 can be coupled to the patch wallboard receiving structure 4 such that the inner surface of the first gripping member 6 and the inner surface of the third gripping member 10 form an angle of about 180° and are substantially in a common plane, as shown in FIG. 1. In this manner, the peripheral portions of the outer surface of the patch wallboard and the outer surface of the existing wallboard will be arranged substantially in a common plane when the patch wallboard is secured in the repaired position within the existing wallboard. Alternatively, the first gripping member 6 and the third gripping member 10 can be constructed to form an angle less than 180° as shown in FIG. 20 at 100 to provide tension against the peripheral portions of the patch wallboard and the existing wallboard captured by the wallboard clip. Examples of suitable angles are between about 1 to about 20° less than 180°, preferably about 2 to about 10° less than 180°. However, if desired, the first and second gripping members 6 and 8 can be formed at any angle and then adjusted by the end user prior to application of the wallboard clip to the patch wallboard and existing wallboard. When the peripheral portions of the patch wallboard and the existing wallboard are captured by the wallboard clip 2, the first gripping member 6 and the third gripping member 10 will flex such that the inner surfaces of the first gripping member 6 and the third gripping member 10 form an angle of about 180° and are substantially on a common plane. In this manner, the peripheral portions of the patch wallboard and the existing wallboard captured by the wallboard clip 2 are aligned on substantially a common plane, regardless of the thicknesses of the patch wallboard and the existing wallboard.

The wallboard clip 2 further includes a locking structure shown generally at 12. The locking structure 12 includes a fourth gripping member 14, that is spaced from and movably coupled with respect to the third gripping member 10. The inner surface, also referred to as a securing surface 15, of the fourth gripping member 14 and the inner surface of the third gripping member 10 are spaced apart about the thickness of the existing wallboard. The fourth gripping member 14 is connected to a sliding surface 16. The sliding surface 16 is coupled to a support 18 which is coupled to the second gripping member 8. Preferably, an end of the fourth gripping member 14 slidably contacts an outer surface of the second gripping member 8, shown generally at 20, to provide enhanced resistance to collapsing of the fourth gripping member 14 during installation of the patch wallboard.

The distance between the inner surfaces of the first gripping member 6 and the second gripping member 8 should be about the thickness of the patch wallboard to provide a secure fit when the wallboard clip 2 is installed on the patch wallboard. The distance will depend on the type of wallboard material utilized. For example, for drywall which has a compressible paper surface the distance can range from about 1/16 inch less than the thickness of the drywall to the thickness of the drywall. Alternatively, if the inner surface of the first gripping member 6 is sloped towards the inner surface of the second gripping member as shown in FIG. 20, during installation of the wallboard clip 2 onto the patch wallboard, the first gripping member 6 can flex away from the second gripping member 8 providing tension between the inside surfaces of the gripping members 6 and 8 and opposing peripheral portions of the patch wallboard there between.

The distance between the third gripping member 10 and the fourth gripping member 14 should be about the thickness of the existing wallboard to provide a secure fit when the patch wallboard is installed in the existing wallboard. The distance will depend on the type of wallboard material utilized. During installation, the third gripping member 10 can flex allowing the fourth gripping member 14 to relax into the locking position against a peripheral portion of the existing wallboard and provide tension between the gripping members 10 and 14. For example, for drywall which has a compressible paper surface the distance can range from about 1/16 inch less than the thickness of the drywall to the thickness of the drywall. Alternatively, if the inner surface of the third gripping member 10 is sloped towards the inner surface of the fourth gripping member 14 as shown in FIG. 20, during installation of the wallboard clip 2 onto the patch wallboard, the third gripping member 10 can flex away from the fourth gripping member 14 providing tension between the inside surfaces of the gripping members 10 and 14 and opposing peripheral portions of the patch wallboard there between. When using drywall, the paper on the inner surface of the existing wallboard may be partially removed when the hole is cut or when the locking structure 12 relaxes into a locked position. Thus, the peripheral portion of the inner surface of the wallboard contacted by the fourth gripping member 14 may be paper and/or the underlying layer of gypsum or other material when the paper is removed. Preferably, the cutting of the hole is performed such that the paper layer is maintained. However, tension provided by the gripping members 10 and 14 of the wallboard clip 2 can easily compensate for removal of the thin layer of paper such that the patch wallboard will be secured by the wallboard clip. The wallboard clip 2 can be constructed and dimensioned to capture any size patch wallboards and existing wallboards as desired. Common sizes are 3/8 inch, 1/2 inch, 5/8 inch and 1 inch.

Figure 3:
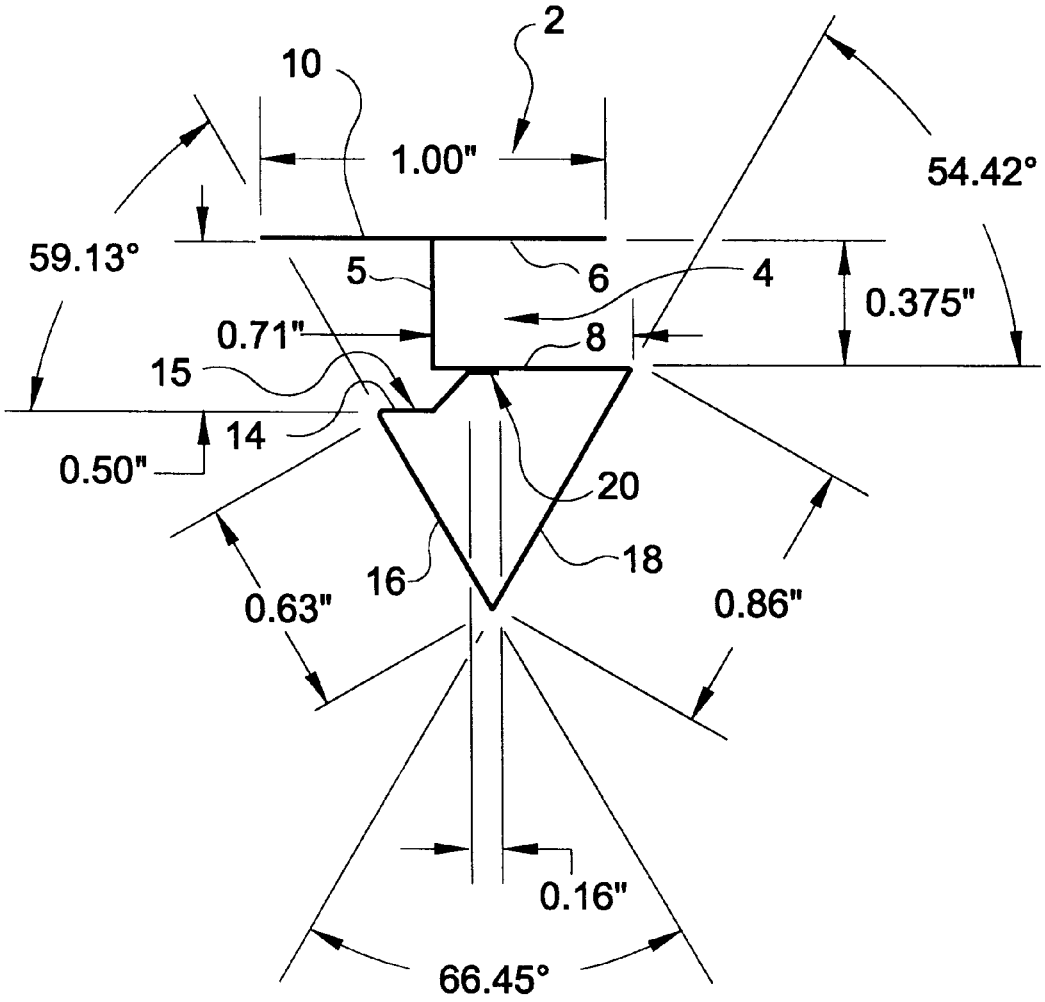
FIG. 3 illustrates a side view of a wallboard clip according to the present invention.

FIG. 3 illustrates a patch wallboard receiving structure 4 which is sized to capture a 3/8 inch patch wallboard and a distance between the inner surface of the fourth gripping member 14 and the inner surface of the existing wallboard receiving member 10 that is sized to capture a 1/2 inch existing wallboard.

Figure 4:
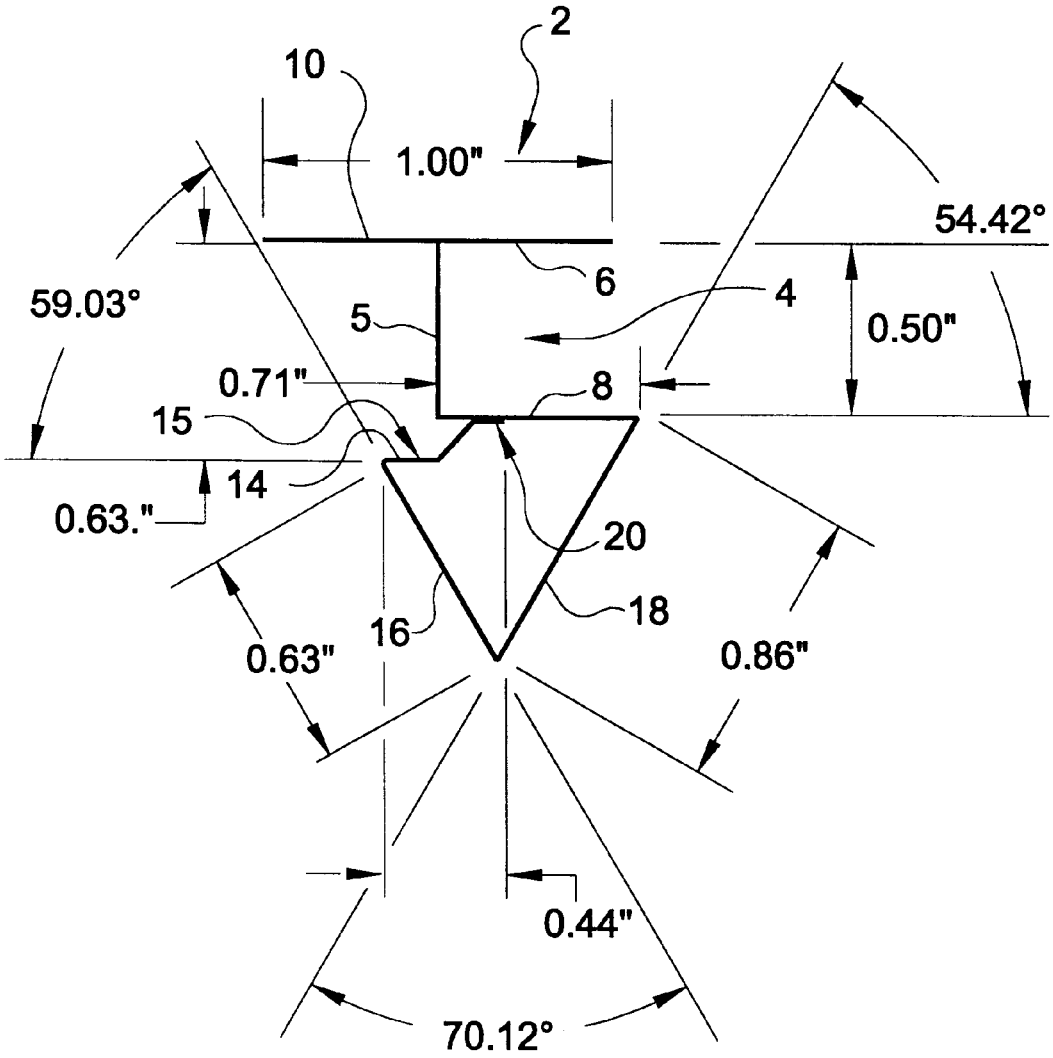
FIG. 4 illustrates a side view of a wallboard clip according to the present invention.

FIG. 4 illustrates a patch wallboard receiving structure 4 which is sized to capture a 1/2 inch patch wallboard and a distance between the inner surface of the fourth gripping member 14 and the inner surface of the existing wallboard receiving member 10 that is sized to capture a 5/8 inch existing wallboard.

Figure 5:
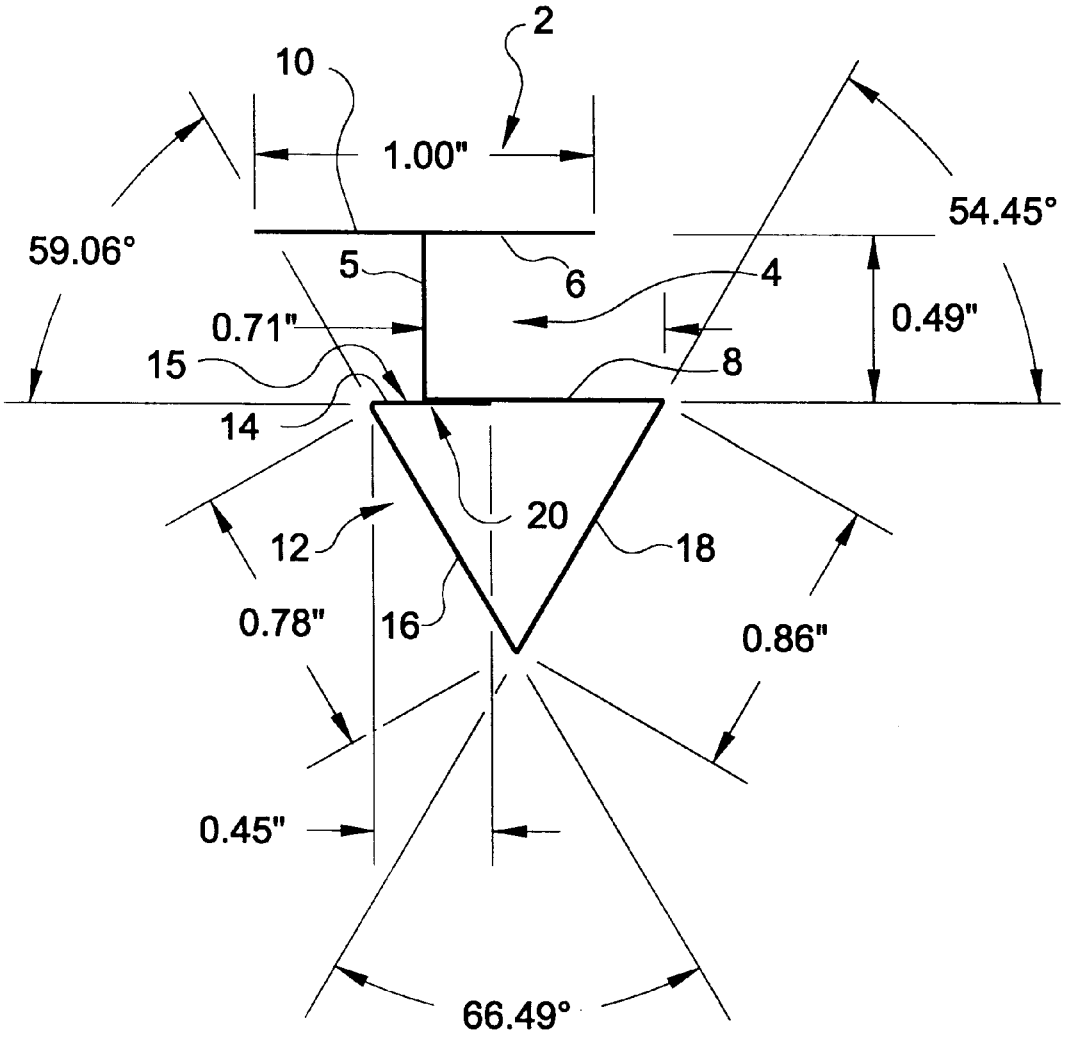
FIG. 5 illustrates a side view of a wallboard clip according to the present invention.

FIG. 5 illustrates a patch wallboard receiving structure 4 which is sized to capture a 1/2 inch patch wallboard and a distance between the inner surface of the fourth gripping member 14 and the inner surface of the existing wallboard receiving member 10 that is sized to capture a 1/2 inch existing wallboard.

Figure 6:
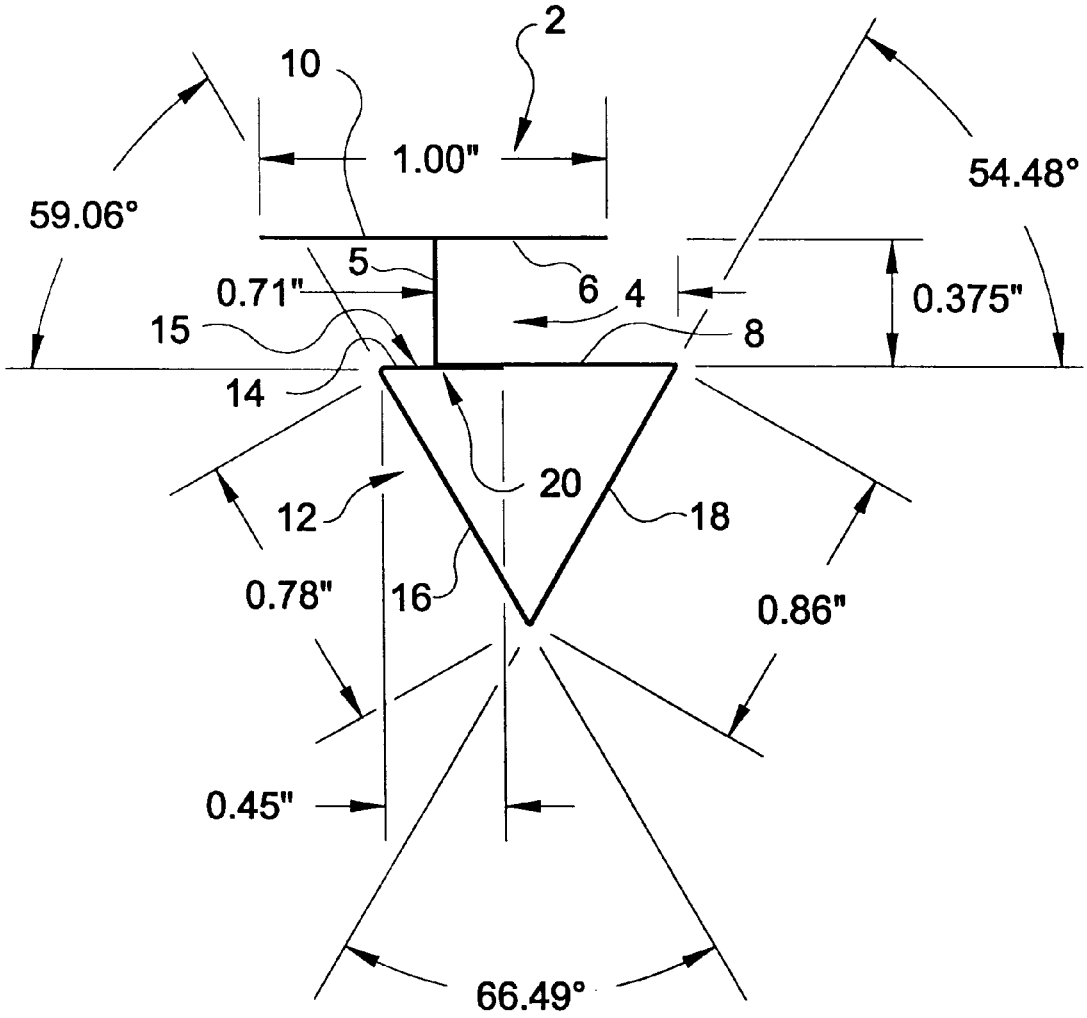
FIG. 6 illustrates a side view of a wallboard clip according to the present invention.

FIG. 6 illustrates a patch wallboard receiving structure 4 which is sized to capture a 3/8 inch patch wallboard and a distance between the inner surface of the fourth gripping member 14 and the inner surface of the existing wallboard receiving member 10 that is sized to capture a 3/8 inch existing wallboard.

Figure 7:
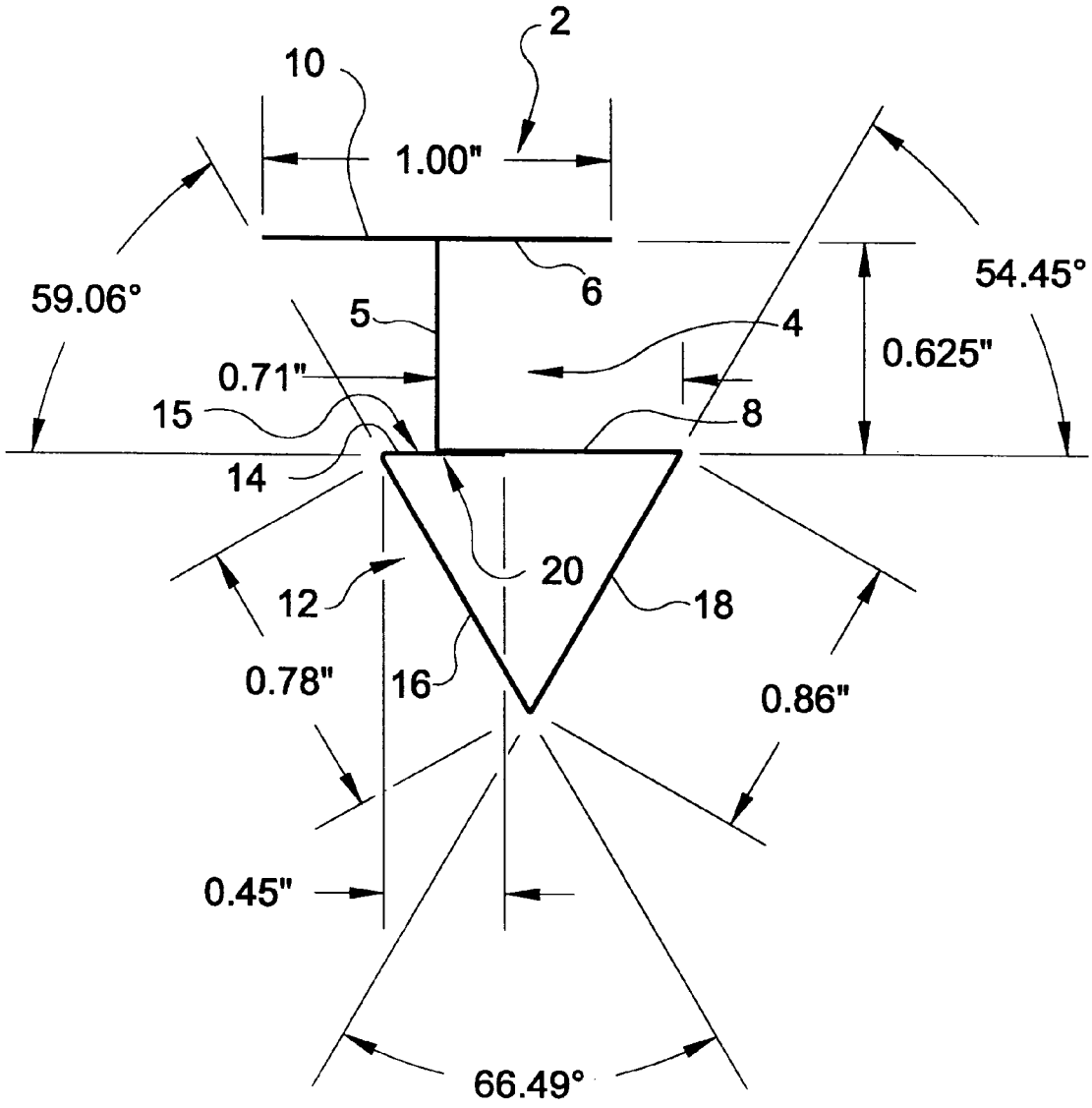
FIG. 7 illustrates a side view of a wallboard clip according to the present invention.

FIG. 7 illustrates a patch wallboard receiving structure 4 which is sized to capture a 5/8 inch patch wallboard and a distance between the inner surface of the fourth gripping member 14 and the inner surface of the existing wallboard receiving member 10 that is sized to capture a 5/8 inch existing wallboard.

Figure 8:
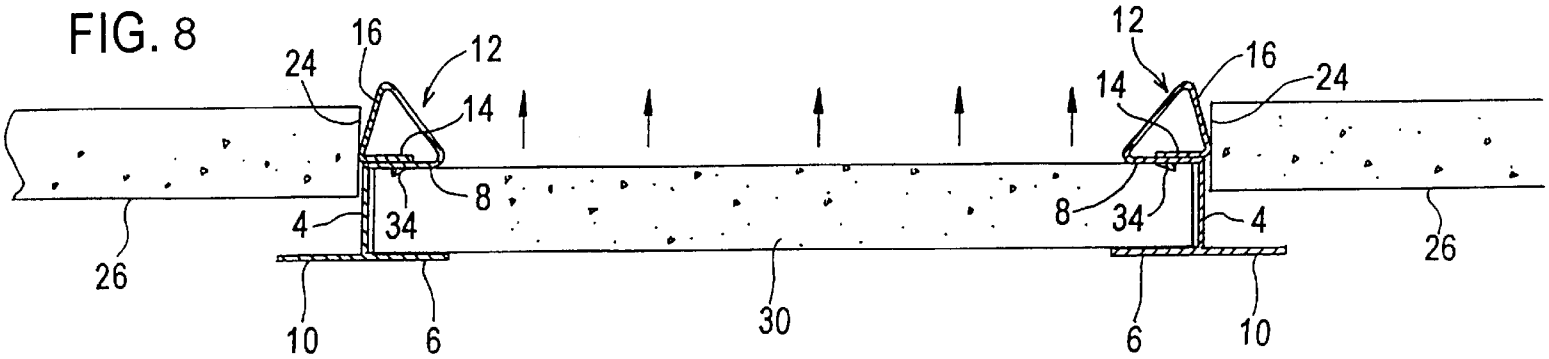
FIG. 8 illustrates a cut away side view of a patch wallboard being installed in an existing wallboard according to the present invention.

As shown in FIG. 8, when force is applied to the sliding surface 16 by contacting the edge 24 of the existing wallboard 26 as the patch wallboard 30 is being installed, the sliding surface 16 moves the fourth gripping member 14 in a direction towards the second gripping member 8. The locking structure 12 is dimensioned such that there is room for the fourth gripping member 14 to move out of the way of the existing wallboard 26 and over gripping member 8 during installation of the patch wallboard 30.

Figure 9:
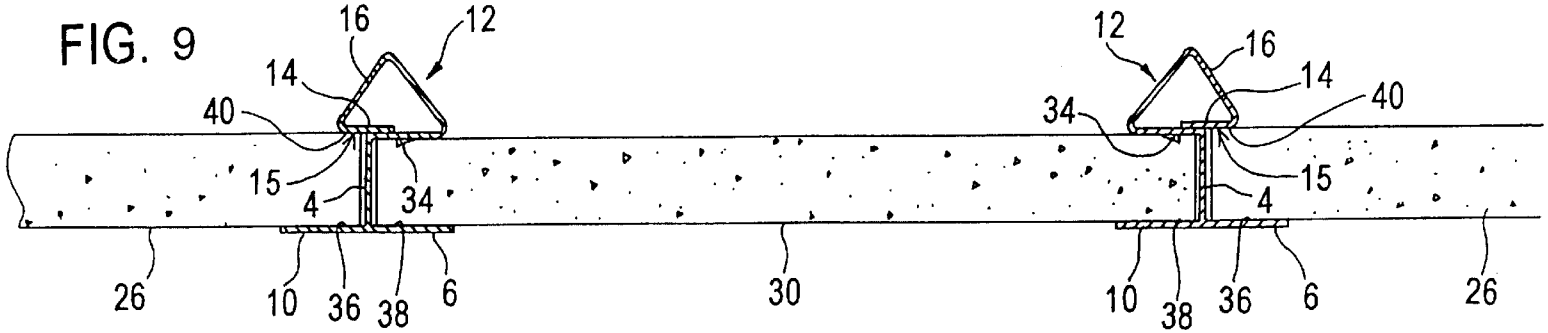
FIG. 9 illustrates a cut away side view of a patch wallboard installed in an existing wallboard according to the present invention.

As shown in FIG. 9, when the patch wallboard 30 is in a repaired position, the sliding surface 16 and the fourth gripping member 14 move into a relaxed position in which an inner surface of the fourth gripping member 14 contacts a peripheral portion of an inner surface of the existing wallboard shown at 36. The peripheral portion of the outer surface of the patch wallboard 38 and the peripheral portion of the outer surface of the existing wallboard 36 are substantially on a common plane.

The locking structure 12 is constructed and arranged to move between a insertion position as shown in FIG. 8 and a locking position as shown in FIG. 9. In the insertion position shown in FIG. 8, the sliding surface 16 of the locking structure 12 is constructed and arranged to press against an edge of the existing wallboard 24 to place the patch wallboard 30 in a repaired position. In the locking position shown in FIG. 9, the sliding surface 16 of the locking structure 12 has moved to a relaxed position permitting a securing surface 15 (also referred to as the inner surface of the fourth gripping member 14) of the locking structure 12 to contact the peripheral portion of an inner surface of the existing wallboard 40 that is opposed to the peripheral portion of the outer surface of the existing wallboard 36, thereby capturing the peripheral portions of inner and outer surfaces of the existing wallboard shown at 40 and 36.

An optional barb 34 can be formed on the second gripping member 8 to provide enhanced gripping of the peripheral portion of the patch wallboard 30.

Figure 10:
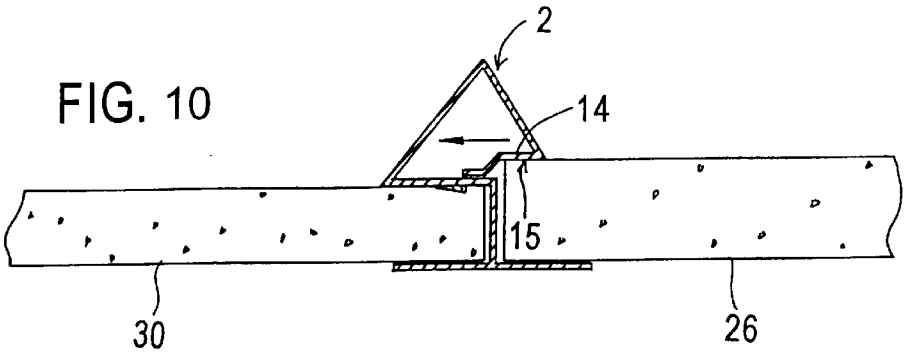
FIG. 10 illustrates a cut away side view of a patch wallboard installed in an existing wallboard according to the present invention.

FIG. 10 illustrates the patch wallboard 30 in the repaired position within the existing wallboard 26, in which the patch wallboard 30 has a different thickness than the existing wallboard 26. The wallboard clip 2 can be constructed and dimensioned to secure any desired thickness of patch wallboard 30 to any desired size existing wallboard 26, and yet provide a flush surface between the outer surfaces of the patch wallboard 30 and the existing wallboard 26.

The wallboard clip 2 shown in FIGS. 1 through 10 can be manufactured by the following steps:

a) providing a metal strip having opposing first and second ends, opposing first and second surfaces, and an axis along the length of the metal strip:

b) cutting the first end of the metal strip substantially in a direction of the axis to form the first gripping member 6 and the third gripping member 10;

c) bending the first gripping member 6 in a first direction to form about a 90° angle or less in relation to the axis;

d) bending the third gripping member 10 in a second direction substantially opposite to the first direction to form about a 90° angle or less in relation to the axis such that inner surfaces of the first and third gripping members form about a 180° angle or less, wherein a body member 5 being defined by a portion of the metal strip contacting the first and second gripping members;

e) bending the metal strip about 90° in relation to the axis in the first direction at an end of the body member 5 to provide a second gripping member 8;

f) bending the metal strip towards the axis at an end of the second gripping member 8 to provide a support 18;

g) bending the metal strip at an end of the support 18 towards the axis to provide a sliding surface 16 which is constructed and arranged to contact and slide along an edge of an existing wallboard during installation of the patch wallboard into the existing wallboard; and h) bending the metal strip at an end of the sliding surface 16 in the first direction thereby defining a fourth gripping member 14, wherein a distance between an inner surface of the first gripping member 6 and an inner surface of the second gripping member 8 is about the thickness of a patch wallboard such that the inner surfaces of the first and second gripping members are capable of capturing a peripheral portion of the inner and outer surfaces of the patch wallboard, and wherein a distance between an inner surface of the fourth gripping member 14 and an inner surface of the third gripping member 10 is about the thickness of the existing wallboard such that the inner surfaces of the third and fourth gripping members are capable of capturing a peripheral portion of inner and outer surfaces of the existing wallboard when the patch wallboard is in a repaired position.

Preferably, the length of the metal strip is such that the fourth gripping member 14 partially extends beyond the axis in the first direction in a relaxed condition and slidably contacts an outer surface of the second gripping member 8 shown at 20. If the method steps (a) through (h) are followed sequentially, the fourth gripping member 14 may have to be tucked behind the second gripping member 8 by flexing the sliding member 16 and support 18.

The steps (a) through (h) can be conducted in any order as desired. For example, step (h) can be conducted first by bending the metal strip in the first direction to form the fourth gripping member 14, followed by steps (g) and (f) to form the sliding surface 16 and support 18. Then step (e) can be conducted to form the second gripping member 8 such that the outer surface of the gripping member 8 slidably contacts the gripping member 14. In this sequence of steps, the fourth gripping member 14 will not have to be tucked behind the second gripping member 8 by flexing the sliding member 16 and support 18. The first and third gripping members can be formed before or following the formation of the second and fourth gripping members. If the length of the metal is such that the fourth gripping member 14 partially extends beyond the axis in the first direction in a relaxed condition and slidably contacts an outer surface of the second gripping member 8 shown at 20, preferably the fourth gripping member 14 is formed prior to forming the second gripping member 8, such that the fourth gripping member 14 does not have to be tucked under the second gripping member 8.

Figure 17:
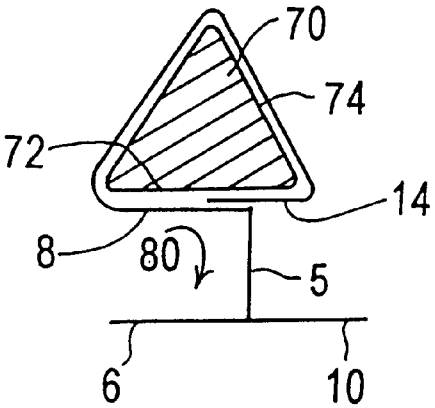
FIG. 17 illustrates a die and step of making a wallboard clip according to the present invention.
Figure 16:
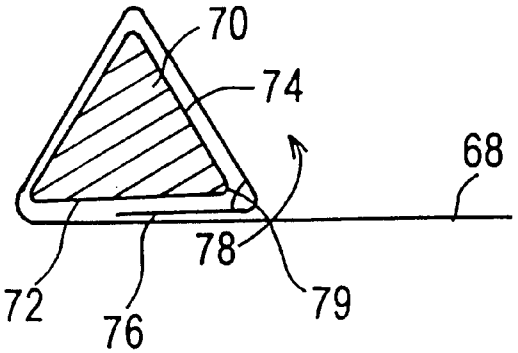
FIG. 16 illustrates a die and step of making a wallboard clip according to the present invention.

FIGS. 16 and 17 illustrate a preferred method for forming the wallboard clip 2 shown in FIGS. 1 through 10, which includes the following steps:

a) providing a metal strip 68 having opposing first and second ends, opposing first and second surfaces, and an axis along the length of the metal strip;

b) providing a die 70 having at least a first outer surface 72 and a second outer surface 74;

c) contacting the second end of the metal strip 76 with the first outer surface 72 of the die 70 such that the first surface of the metal strip contacts the first outer surface 72 of the die 70;

d) bending the metal strip in a first circular direction 78 around the die 70 such that the first surface of the metal strip contacts a portion of the second surface of the metal strip located on the first surface of the die and overlaps the second surface of the metal strip at the second end of the metal strip 76, with a fourth gripping member 14 being defined by the second end of the metal strip 76 and the part of the metal strip shaped by the first surface of the die, a sliding surface 16 being defined by the part of the metal strip shaped by the second surface of the die, and a second gripping member 8 being defined by a part of the metal strip shaped by the first surface of the die and overlapping a part of the fourth griping member 14, the first and second outer surfaces of the die 70 forming an acute angle such that the fourth gripping member 14 and the sliding surface 16 form an acute angle 79 as shown in FIGS. 16 and 17;

e) bending the metal strip in a second circular direction 80 opposite to the first circular direction 78 at an end of the second gripping member 8 to form a body member 5;

f) cutting the first end of the metal strip substantially in a direction of the axis to form the first gripping member 6 and the third gripping member 10;

g) bending the first gripping member 6 towards the second gripping member 8 at a location on the metal strip such that a distance between the inner surface of the first gripping member 6 and an inner surface of the second gripping member 8 is about the thickness of a patch wallboard such that the inner surfaces of the first and second gripping members are capable of capturing a peripheral portion of the inner and outer surfaces of the patch wallboard;

h) bending the third gripping member 10 towards the fourth gripping member 14 such that inner surfaces of the first and third gripping members form about a 180° angle or less at a location on the metal strip such that a distance between an inner surface of the fourth gripping member 14 and an inner surface of the third gripping member 10 is about the thickness of the existing wallboard or less such that the inner surfaces of the third and fourth gripping members are capable of capturing a peripheral portion of inner and outer surfaces of the existing wallboard when the patch wallboard is in a repaired position; and i) removing the metal strip from the die.

The steps (e), (g) and (h) are preferably conducted such that the body member 5 is substantially perpendicular to the common plane formed by the inner surfaces of second and fourth gripping members. The metal strip is preferably bent in step (e) at a location such that the sliding surface 16 extends to both sides of the body member 5, as shown in FIGS. 1 and 17.

Figure 19:
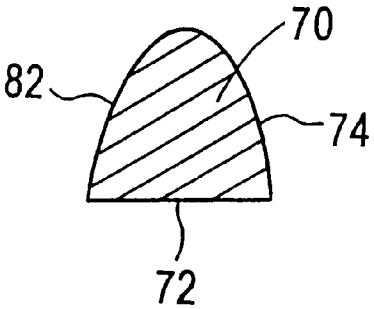
FIG. 19 illustrates an alternative die for use in a method according to the present invention.
Figure 18:
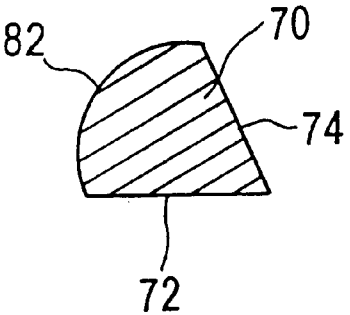
FIG. 18 illustrates an alternative die for use in a method according to the present invention.

The die 70 is preferably triangular shaped as shown in FIGS. 16 and 17. However, the die 70 can have other shapes, such as those shown in FIGS. 18 and 19. The outer surface 82 of the die 70 which forms the support 18 can be curved, have multiple bends, or be substantially flat as shown in FIG. 1. Preferably, the die 70 is substantially an isosceles triangle which is capable of forming the wallboard clip shown in FIG. 20. Furthermore, the first outer surface 72 and the second outer surface 74 can be curved or flat as desired. For example, the second outer surface 74 can be curved to form a convex surface such that the sliding surface 16 is convex, as shown in FIG. 19. Preferably, the first outer surface 72 and the second outer surface 74 are substantially flat to provide the sliding surface 16 and the fourth gripping member 14 with substantially flat surfaces.

In the above methods, the die 70 can be stationary and metal strip wrapped around the die 70, or the die 70 can rotate, or combinations thereof.

The metal strip is flexible such that when force is exerted against the sliding surface 16 by the edge of the existing wallboard during installation of the patch wallboard the fourth gripping member 14 is capable of moving substantially in the first direction to an insertion position and when the patch wallboard is in a repaired position within the existing wallboard the fourth gripping member 14 is capable of moving into a locking position in which the inner surface of the fourth gripping member 14 can contact the peripheral portion of an inner surface of the existing wallboard. To provide a wallboard clip 2 as shown in FIG. 5, about a 4 inch strip of metal having a thickness of about 1/64 inch and a width of about 5/8 inch was used. To provide a wallboard clip 2 as shown in FIG. 20, about a 3.8 inch long strip of metal having a thickness of about 0.01 inch and a width of about 5/8 inch was used.

While the wallboard clip 2 can be formed from a continuous metal strip as shown in FIGS. 1–17, the wallboard clip 2 can also be formed from any suitable material as desired, such as plastics, metals, composites, wood materials, and mixtures thereof. The wallboard clip 2 can be molded, machined, extruded, formed by cutting, bending or pressing, or any other suitable method. For example, the wallboard clip 2 can be formed from extruded metals, such as aluminum. The wallboard clip 2 can also be formed from a plurality of separate parts which are coupled together, such as by bonding, welding, screwing, bolting, riveting, molding and adhesives. Based on the disclosure provided herein, one skilled the art will be able to select a suitable material for the desired wallboard clip. In order to comply with many building codes, the wallboard clip 2 should be formed from a non-flammable material. Preferably, the wallboard clip 2 is formed from a continuous strip of metal, and more preferably from a corrosion resistant flexible metal, such as stainless steel or corrosion treated steel including galvanized steel. The metal can be annealed to provide enhanced strength. The dimensions of the metal strip will depend on particular application and the type of metal utilized. For drywall having a thickness of about 1 inch or less, examples of suitable thicknesses of the metal are from about 1/8 inch or less, more preferably about 0.01 to about 0.02 inch thick, and examples of suitable widths are about 1 inch or less, preferably about 5/8 inch. However, if desired significantly wider wallboard clips can be formed for the desired application. For example, a wide wallboard clip can be used in place of thinner wallboard clips if desired.

As the size the patch wallboard and hole increases, the number of wallboard clips or size of the wallboard clips can be increased. Generally, the greater the size of the patch wallboard and hole, the greater the number of wallboard clips required. The number of wallboard clips required will depend on local building codes. Usually, local building codes can be complied with using a sufficient number of wallboard clips such that the spacing between the wallboard clips is about 5 to 8 inches.

Figure 11:
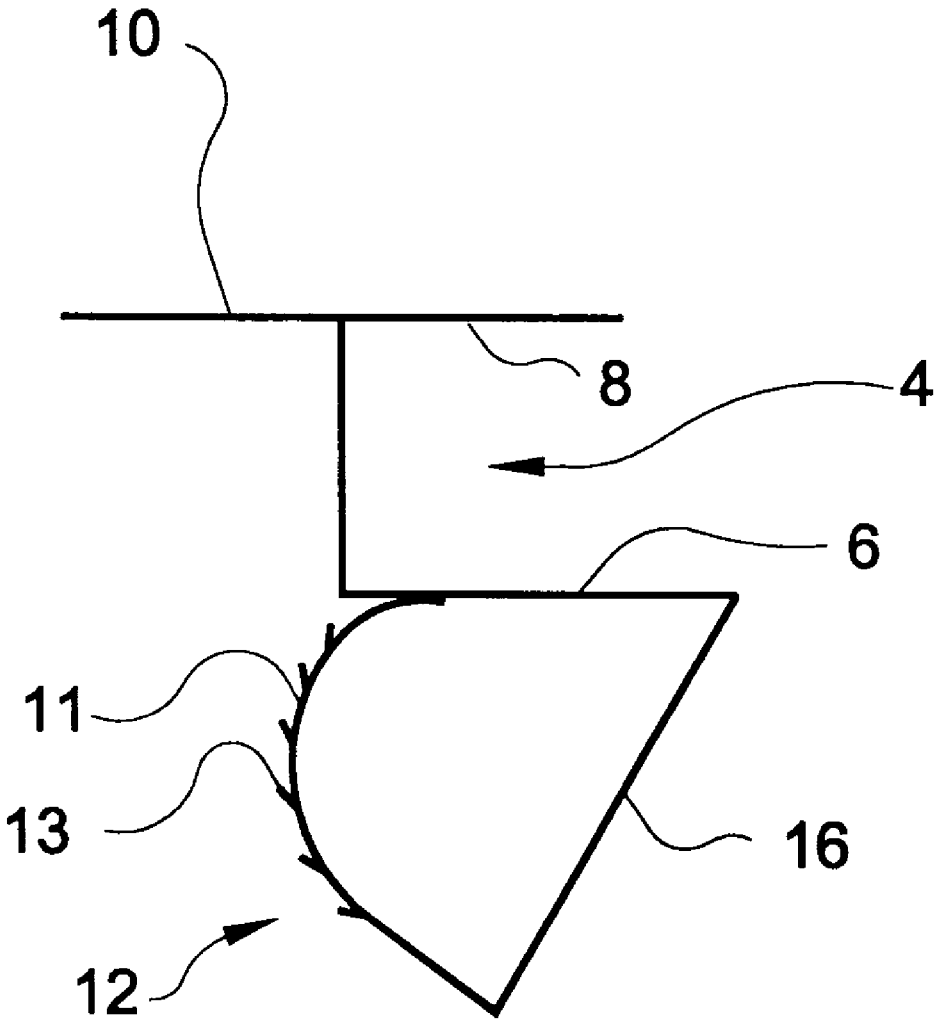
FIG. 11 illustrates an alternative wallboard clip according to the present invention.

An example of an alternative wallboard clip is shown in FIG. 11. The sliding surface 11 is curved and contains barbs 13 that act as the fourth gripping member and contact a peripheral portion of the inner surface of the existing wallboard once the patch wallboard is in a repaired position.

The wallboard clip 2 can be used to repair a hole 52 in existing wallboard 54 between studs 51, as shown in FIGS. 12 through 15. A patch wallboard 50 having a surface area greater than the hole 52 is provided. The patch wallboard 50 preferably has a square or rectangular shape for simplification, although any shape can be utilized as desired. The patch wallboard 50 is placed over the hole 52 and the shape of the patch wallboard 50 is inscribed on the surface of the existing wallboard 54. A hole 56 is then cut in existing wallboard 54 in the shape of the inscription such that the patch wallboard 50 fits within the hole 56. Wallboard clips 2 are then mounted on the patch wallboard 50. Preferably, at least one wallboard clip 2 is mounted on each side of the patch wallboard 50. The patch wallboard 50 having the wallboard clips 2 mounted thereon is then pushed into the hole 56 until a peripheral portion of the outer surface of the existing wallboard 54 contacts the third gripping member 10 of the wallboard clip 2, at which point the locking structure 12 relaxes into a locking position in which the fourth gripping member 14 moves out behind the existing wallboard 54 and contacts a peripheral portion of the inner surface of the existing wallboard 54. However, the patch wallboard 50 may move slightly past the repaired position during installation in which the third gripping member 10 will flex until the locking structure 12 is in a position to relax and once pressure is released against the existing wallboard 54 by the user the patch wallboard 50 will move back into a repaired position in which the fourth gripping member 14 presses against the inner surface of the existing wallboard 54. When using drywall, the paper on the inner surface of the existing wallboard may be at least partially removed when the hole is cut or when the locking structure 12 relaxes into a locked position. Thus, the peripheral portion of the inner surface of the wallboard contacted by the locking structure 12 may be paper and/or the underlying layer of gypsum or other material when the paper is removed. However, tension in the gripping members of the wallboard clip can easily compensate for the removal of the thin layer of paper such that the patch wallboard will be secured by the wallboard clip. In this manner, the peripheral opposing inner and outer surfaces of the patch wallboard 50 and peripheral opposing inner and outer surfaces of the existing wallboard 54 are securely gripped by the wallboard clips 2 when the patch wallboard 50 is in a repaired position. The wallboard clips 2 ensure that a flush outer surface is obtained between the peripheral portions of the patch wallboard 50 and the existing wallboard 54 irrespective of the thickness of the patch wallboard 50 or the existing wallboard 54 once the patch wallboard 50 is in a repaired position. Once the patch wallboard 50 is in a repaired position, the joints between the patch wallboard 50 and the existing wallboard 54 and the first and third gripping members 6 and 10 can be covered by an any conventional method, such as by using joint tape and/or plaster 58. The present invention is not limited to repairing a hole between studs. The present invention may also be used to repair a hole exposing one or more studs.

Figure 21:
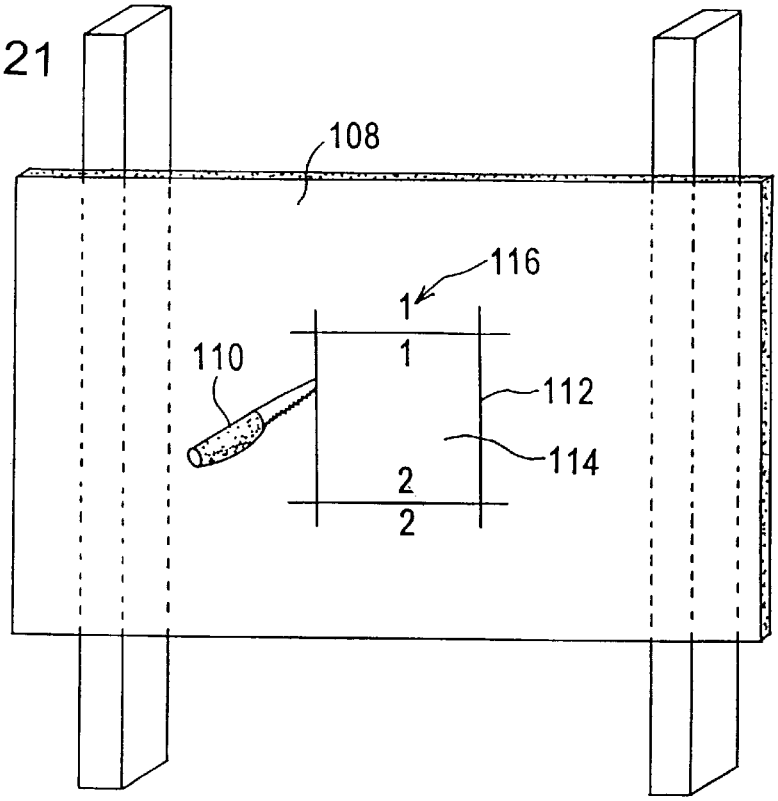
FIG. 21 illustrates a cutout being formed in existing wallboard for access to an interior of a hollow wall.
Figure 22:
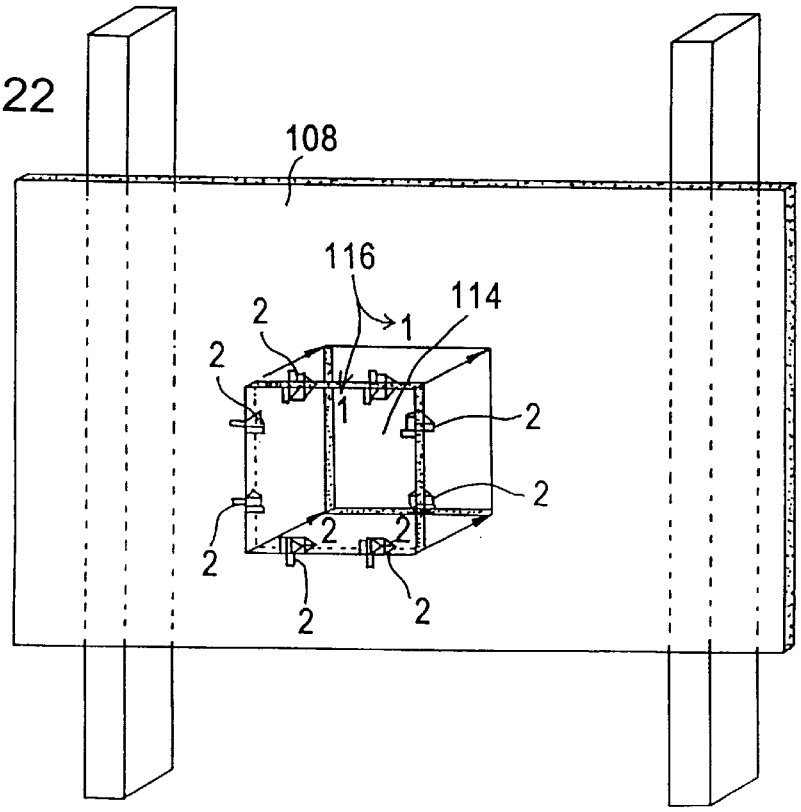
FIG. 22 illustrates wallboard clips being attached to the patch wallboard formed by the cutout.
Figure 23:
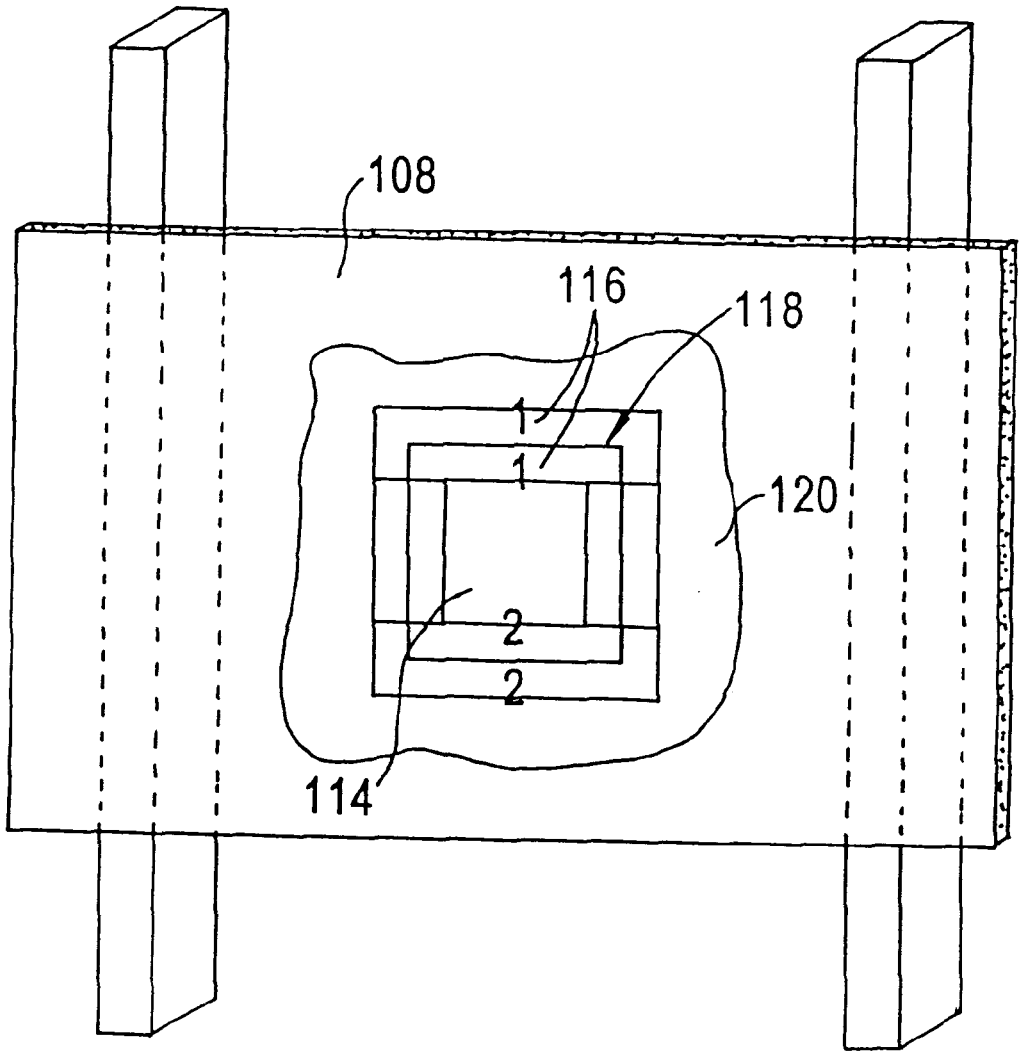
FIG. 23 illustrates the patch wallboard secured in an installed position with the wallboard clips and then coated with tape and spackle.

The present invention also provides a novel method of accessing an interior of a hollow wall. Trades persons, such as electricians and plumbers, routinely require access to the interior of hollow walls to make repairs or for new installations. A hole having any desired size or shape can be cut in the wall to access the interior of the wall. The cut is preferably formed using a thin knife or saw, as shown in FIG. 21. For example, when the wallboard comprises drywall 108, a thin drywall knife 110 can be used to cut out the shape 114 of the hole and then the portion of the wallboard 112 defined by the cut can be removed. Once access to the hollow wall is no longer needed, the hole can be repaired by using the portion of the wallboard 114 removed as the patch wallboard in the manner shown in FIGS. 13 through 15. A reference mark 116 is preferably made on the portion of the wallboard removed 114 and the existing wallboard 108 to ensure that the portion of the wallboard removed 114 is inserted in the correct position. In this manner, waste wallboard material from accessing the interior of a hollow wall can be avoided. FIG. 22 illustrates the wallboard clips 2 mounted on the periphery of the portion of wallboard 114 removed (now referred to as a patch wallboard 114). FIG. 23. illustrates the patch wallboard 114 installed in the existing wallboard 108. The wallboard clips 2 and the cutout are concealed by the joint tape 118 and the spackle 120.

The novel wallboard clips 2 can also be used along joints between wallboard to secure one wallboard to another.

The present invention further includes a kit for repairing a hole in existing wallboard. The kit includes a plurality of wallboard repair clips and a patch wallboard. The kit optionally includes joint tape and joint compound, such as plaster or spakling, for covering the joint between the patch wallboard and the existing wallboard. The kit can also contain a tool for cutting a hole in the existing wallboard, such as a knife 110 or saw.

Figure 13:
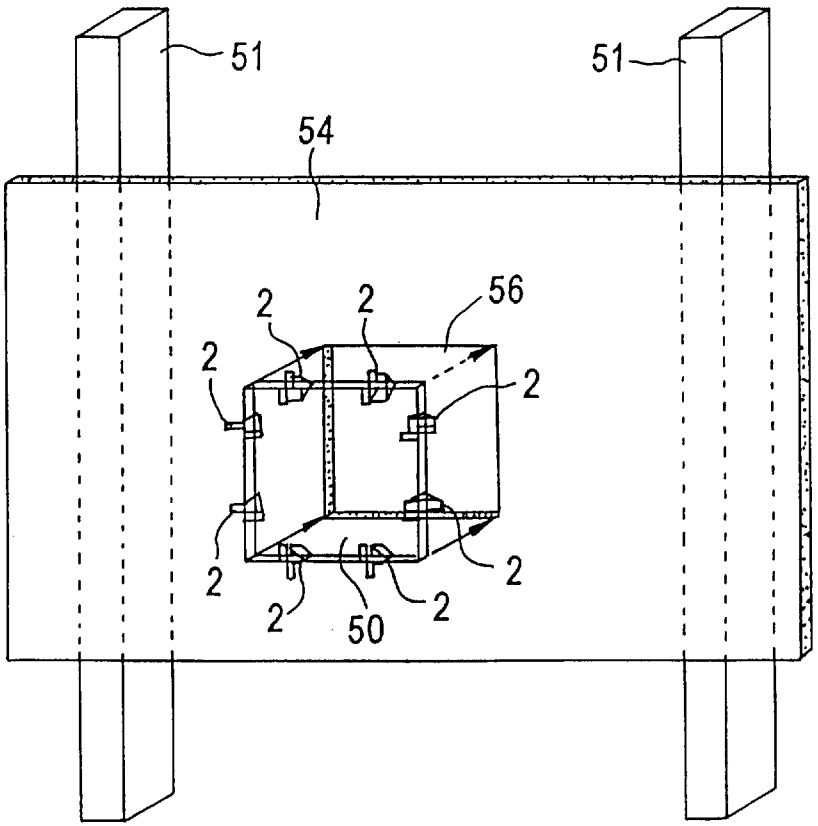
FIG. 13 illustrates a step of repairing a hole in an existing wallboard according to the present invention.
Figure 12:
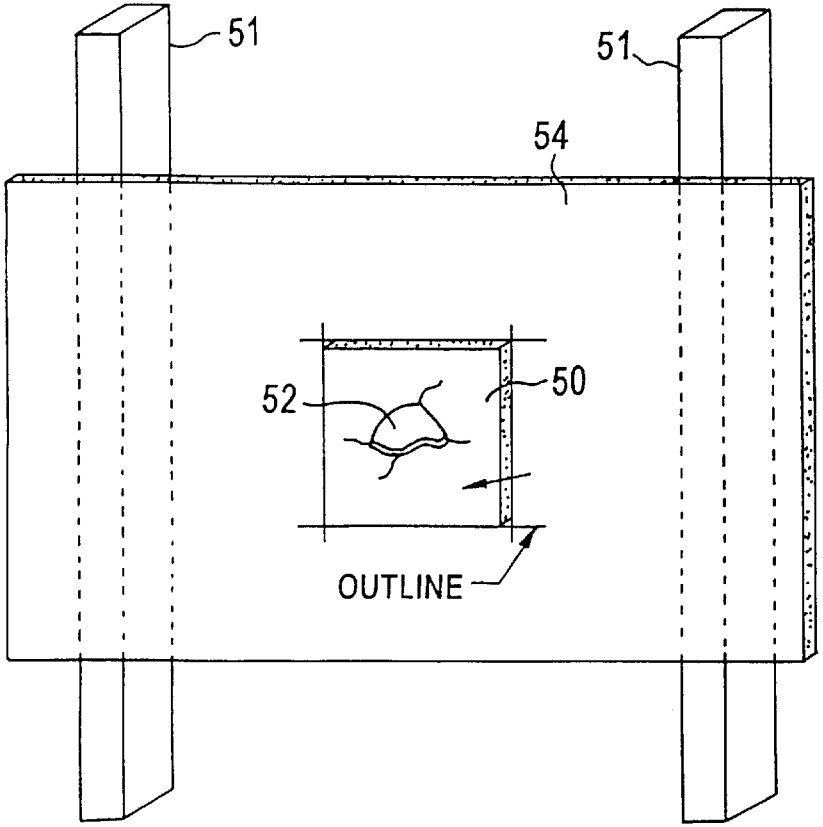
FIG. 12 illustrates a step of repairing a hole in an existing wallboard according to the present invention.
Figure 15:
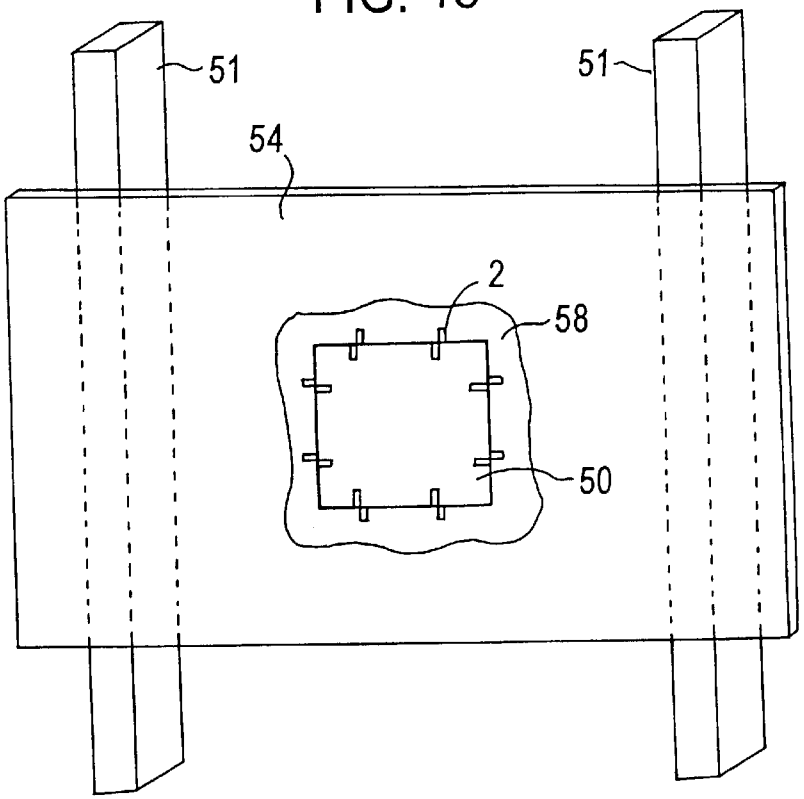
FIG. 15 illustrates a step of repairing a hole in an existing wallboard according to the present invention.
Figure 14:
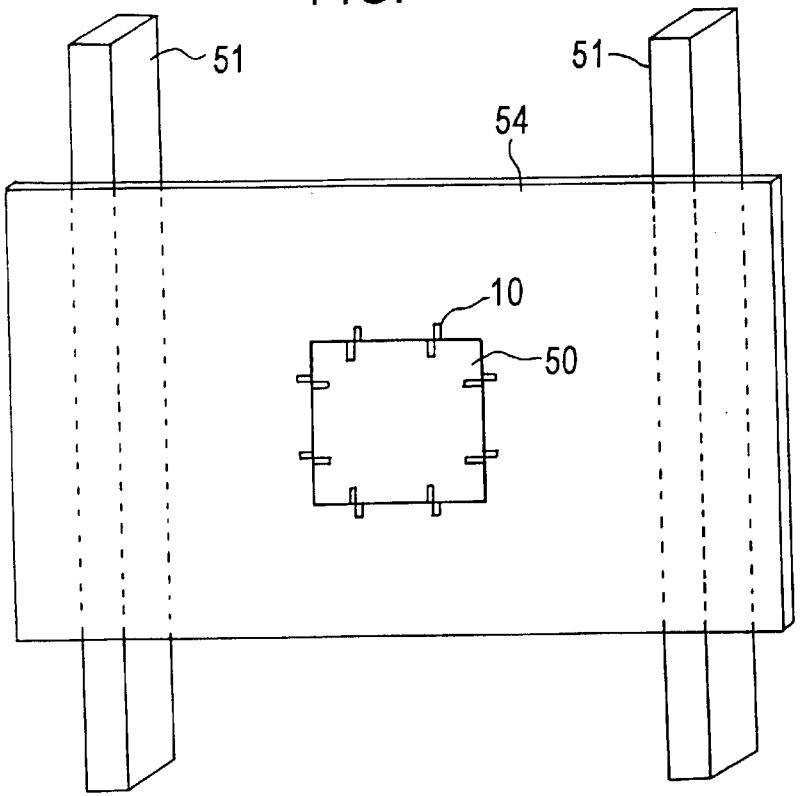
FIG. 14 illustrates a step of repairing a hole in an existing wallboard according to the present invention.
Figure 24:
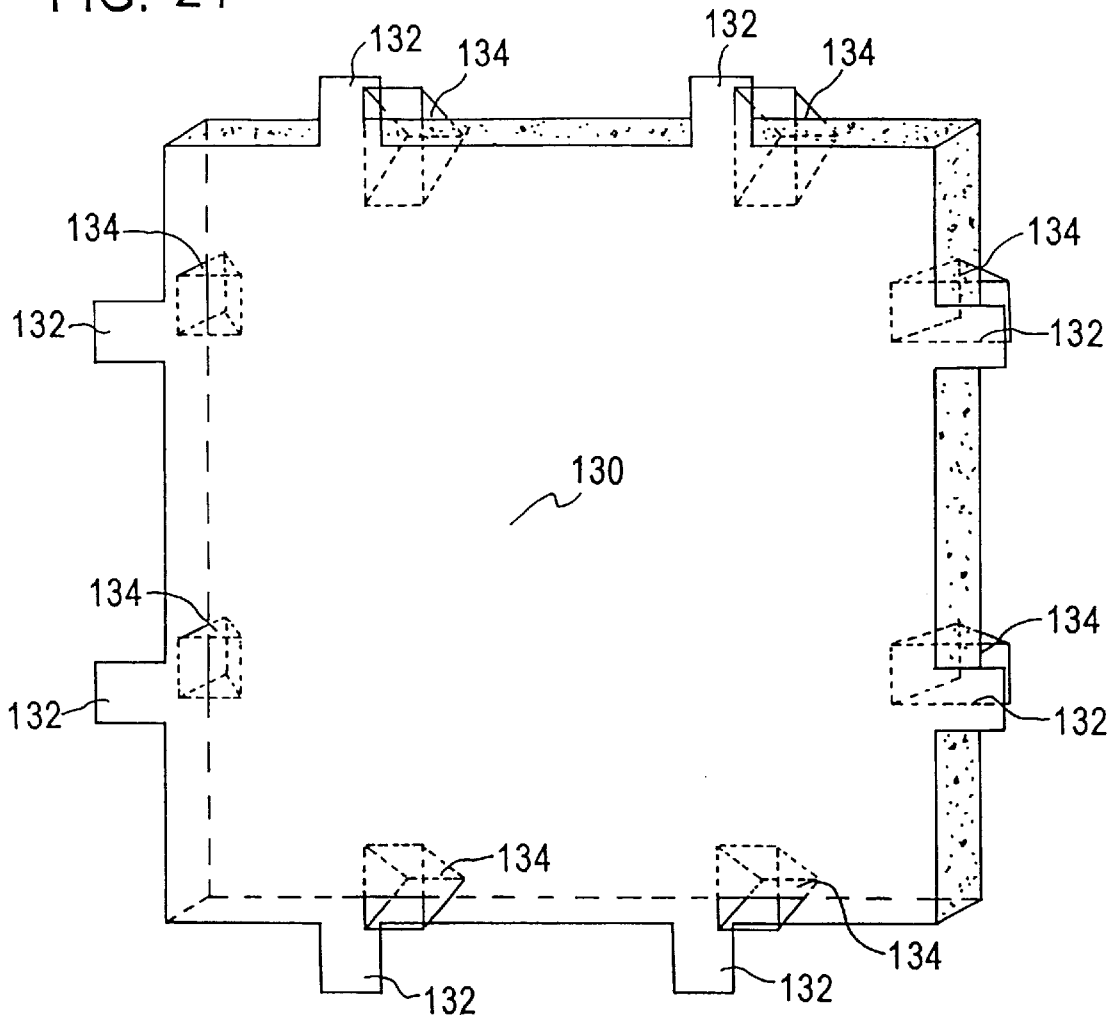
FIG. 24 illustrates a patch wallboard having integrally formed wallboard clips.
Figure 25:
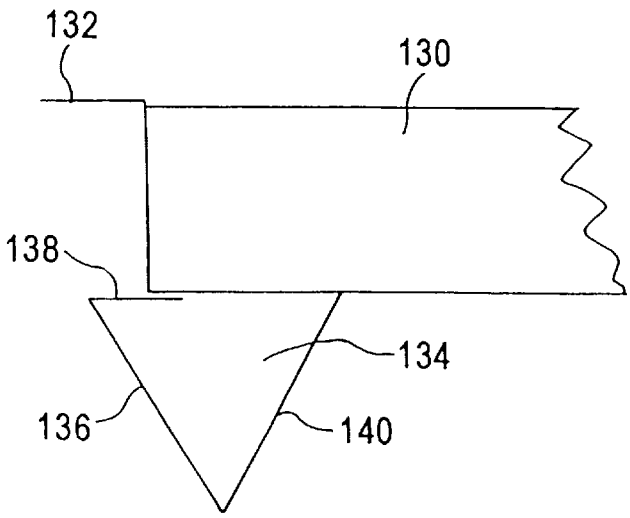
FIG. 25 illustrates a cutaway side view of the patch wallboard having integrally formed wallboard clips.

The present invention also provides a novel patch wallboard containing a plurality of wallboard clips around the periphery of the patch wallboard for securing the patch wallboard to a hole in an existing wallboard, such as the patch wallboard 50 containing wallboard clips 2 shown in FIG. 13. Alternatively, the wallboard clips can be integrally formed with the patch wallboard 130 as shown in FIGS. 24 and 25. The patch wallboard 130 containing integrally formed wallboard clips can be formed from any suitable material, such as metal, plastic, fiberglass, and combinations thereof. The integrally formed wallboard clips include an existing wallboard receiving member 132 and a locking structure 134. The locking structure 134 includes a fourth gripping member 138 which is movable coupled with respect to the existing wallboard receiving member 132. The inner surfaces of the existing wallboard receiving member 132 and the fourth gripping member 138 is about the thickness of the existing wallboard. In general, the existing wallboard receiving member 132 and the fourth gripping member 138 are constructed and arranged in a similar manner to the third gripping member 10 and fourth gripping member 14 described above. The locking structure 134 also includes a sliding surface 136 and a support 140. The locking structure 134 can be constructed and arranged in a manner similar to the locking structure 12 described above except that the locking structure 134 is integrally formed or connected to the patch wallboard instead of a body member. The existing wallboard receiving member 132 is preferably constructed such that a peripheral portion of the existing wallboard captured by the existing wallboard member 132 is substantially on a common plane with a peripheral portion of the patch wallboard 130.

While the invention has been described in detail and with reference to specific embodiments thereof, it will be apparent to those of ordinary skill in the art that various changes and modifications can be made to the claimed invention without departing from the spirit and scope thereof. For example, any locking structure having an insertion position that allows the patch wallboard to be installed and a locking position which contacts an inner surface of the existing wallboard when the patch wallboard is in a repaired position can be utilized in the wallboard clip.

What is claimed is:

1. A wallboard clip for securing a patch wallboard to an existing wallboard to repair the existing wallboard, the wallboard clip comprising:

patch wallboard receiving structure constructed and arranged to receive a patch wallboard so as to capture a peripheral portion of inner and outer opposing surfaces of the patch wallboard;

an existing wallboard receiving member constructed and arranged to contact a peripheral portion of an outer surface of an existing wallboard to be repaired, said existing wallboard receiving member being coupled to said patch wallboard receiving structure such that the peripheral portion of the outer surface of the patch wallboard and the peripheral portion of the outer surface of the existing wallboard are arranged substantially in a common plane when the patch wallboard is in a repaired position within the existing wallboard; and locking structure spaced from and coupled to said wallboard receiving member, said locking structure being constructed and arranged to move between an insertion position, wherein a sliding surface of said locking structure is constructed and arranged to contact and slide against an end of the existing wallboard to place the patch wallboard in the repaired position, and a locking position, wherein said sliding surface of said locking structure is in a relaxed position permitting a securing surface of the locking structure to contact a peripheral portion of an inner surface of the existing wallboard that is opposed to the peripheral portion of the outer surface of the existing wallboard thereby capturing the peripheral portions of inner and outer surfaces of the existing wallboard when the patchboard is in the repaired position.

2. A wallboard clip according to claim 1, wherein said wallboard clip is formed from a continuous strip of metal.

3. A wallboard clip according to claim 1, wherein said wallboard clip is formed from a molded or extruded material.

4. A wallboard clip according to claim 1, wherein said patch wallboard receiving structure comprises first and second gripping members having inner surfaces which are spaced apart about the thickness of the patch wallboard.

5. A wallboard clip according to claim 4, wherein said second gripping member is constructed and arranged to contact the peripheral portion of the inner surface of the patch wallboard and said second gripping member contains a barb for enhancing the securing of the existing patch wallboard within said patch wallboard receiving structure.

6. A wallboard clip according to claim 1, wherein said patch wallboard receiving structure comprises first and second gripping members having inner surfaces which are substantially parallel to one another.

7. A wallboard clip according to claim 1, wherein said existing wallboard receiving structure comprises a third gripping member and said locking structure comprises a fourth gripping member.

8. A wallboard clip according to claim 7, wherein said third and fourth gripping members having inner surfaces which are spaced apart about the thickness of the existing wallboard.

9. A wallboard clip according to claim 7, wherein said third and fourth gripping members having inner surfaces which are substantially parallel to one another.

10. A wallboard clip according to claim 4, wherein a distance between said inner surfaces of said first and second gripping members and said first gripping member is formed from a flexible material such that during installation of the peripheral portion the patch wallboard into said patch wallboard receiving structure said first gripping member flexes away from said second gripping member to allow the peripheral portion of the patch wallboard to slide into said patch wallboard receiving structure and to capture the patch wallboard by providing tension between said inner surfaces of said first and second gripping members and the inner and outer peripheral portions of the patch wallboard.

11. A wallboard clip according to claim 1, wherein said patch wallboard receiving structure comprises first and second gripping members, said existing wallboard receiving member comprises a third gripping member and said locking structure comprises a fourth gripping member, wherein said first gripping member is sloped towards said second gripping member and said third gripping member is sloped towards said fourth gripping member such that during installation of the wallboard clip onto the patch wallboard said first gripping member flexes away from said second gripping member providing tension between the inside surfaces of said first and second gripping members and opposing peripheral portions of the patch wallboard there between, and during installation of the patch wallboard into the existing wallboard said third gripping member flexes away from said fourth gripping member providing tension between the inside surfaces of said third and fourth gripping members and opposing peripheral portions of the existing wallboard there between.

12. A wallboard clip for securing a patch wallboard to an existing wallboard to repair the existing wallboard, said wallboard clip comprising:

a body member;

first and second gripping members coupled to a first side of said body member, said first and second gripping members having opposed inner faces which are constructed and dimensioned to capture and secure a peripheral portion of inner and outer opposing surfaces of a patch wallboard;

a third gripping member coupled to a second side of said body member opposing said first side of said body member, said third gripping member having an inner surface; and a fourth gripping member movably coupled with respect to said second side of said body member and having an inner surface opposing said inner surface of said third gripping member, said inner surfaces of said third and fourth gripping member being constructed and dimensioned to capture and secure a peripheral portion of inner and outer opposing surfaces of an existing wallboard, said fourth gripping member being coupled to a sliding surface, said sliding surface being constructed and arranged to contact and slide against an edge of the existing wallboard during installation of the patch wallboard and move said fourth gripping member towards said first surface of said body member to allow the patch wallboard to be inserted in the existing wallboard and when the patch wallboard is in a repaired position within the wallboard said sliding surface is constructed to allow said fourth gripping member to move into a position against a peripheral portion of an inner surface of the existing wallboard, and wherein said first and third gripping members being constructed and arranged such that the peripheral outer surfaces of the patch wallboard and the existing wallboard are substantially on a common plane when the patch wallboard is in a repaired position within the existing wallboard.

13. A wallboard clip according to claim 12, wherein said sliding surface is a curved surface.

14. A wallboard clip according to claim 12, wherein said sliding surface forms an acute angle with said inner surface of said fourth gripping member such that said sliding surface slopes towards said body member.

15. A wallboard clip according to claim 12, wherein said sliding surface is constructed and arranged such that the sliding surface does not contact the edge of the existing wallboard when the patch wallboard is in a repaired position within the existing wallboard.

16. A wallboard clip according to claim 12, wherein said inner surfaces of said first and second gripping members are substantially parallel.

17. A wallboard clip according to claim 12, wherein said inner surfaces of said third and fourth gripping members are substantially parallel.

18. A wallboard clip according to claim 12, wherein said wallboard clip is formed from a continuous strip of metal.

19. A wallboard clip according to claim 12, wherein said wallboard clip is formed from a molded or extruded material.

20. A wallboard clip according to claim 12, wherein said first gripping member slopes towards said second gripping member and said third gripping member slopes towards said fourth gripping member.

21. A wallboard clip for securing a patch wallboard to an existing wallboard, said wallboard clip comprising:

a body member;

first and second gripping members coupled to a first side of said body member, said first and second gripping members having opposed inner surfaces disposed about 0.25 to about 1 inch apart;

a third gripping member coupled to a second side of said body member opposing said first side of said body member, said third gripping member having an inner surface; and a fourth gripping member movably coupled with respect to said second body member and having an inner surface opposing said inner surface of said third gripping member, said inner surfaces of said third and fourth gripping members being disposed about 0.25 to about 1 inch apart, said fourth gripping member being constructed and arranged to move between an insertion position, wherein a patch wallboard having said wallboard clip mounted thereon can be inserted into a hole in an existing wallboard, and a locking position, wherein said fourth gripping member contacts a peripheral portion of an inside surface of an existing wallboard.

22. A wallboard clip according to claim 21, wherein said fourth gripping member being coupled to a sliding surface.

23. A wallboard clip according to claim 21, wherein inner surfaces of said first and fourth gripping member forming an angle of about 180° or less.

24. A wallboard clip according to claim 21, wherein said first and third gripping members being constructed and arranged such that peripheral outer surfaces of a patch wallboard and an existing wallboard are substantially on a common plane when the patch wallboard is secured by the wallboard clip in a repaired position within the existing wallboard.

25. A wallboard clip according to claim 21, wherein said first and second gripping members having opposed inner faces disposed about 0.5 inch apart and said inner surfaces of said third and fourth gripping members being disposed about 0.5 inch apart.

26. A wallboard clip according to claim 21, wherein said first and second gripping members having opposed inner faces disposed about ⅜ inch apart and said inner surfaces of said third and fourth gripping members being disposed about ⅜ inch apart.

27. A wallboard clip according to claim 21, wherein said first and second gripping members having opposed inner faces disposed about ⅝ inch apart and said inner surfaces of said third and fourth gripping members being disposed about ⅝ inch apart.

28. A wallboard clip according to claim 21, wherein said wallboard clip is formed from a continuous strip of metal.

29. A wallboard clip for securing a patch wallboard to an existing wallboard, said wallboard clip comprising:

a body member:

first and second gripping members coupled to a first side of said body member, said first and second gripping members having opposed inner surfaces;

a third gripping member coupled to a second side of said body member opposing said first side of said body member, said third gripping member having an inner surface;

a fourth gripping member movably coupled with respect to said body member and having an inner surface opposing said inner surface of said third gripping member, said inner surfaces of said third and fourth gripping members; and a sliding surface coupled to said fourth gripping member, wherein said sliding surface being constructed and arranged to contact and slide against an edge of the existing wallboard during installation of the patch wallboard and move said fourth gripping member towards said first surface of said body member to allow the patch wallboard to be inserted in the existing wallboard and when the patch wallboard is in a repaired position within the wallboard said sliding surface is constructed to allow said fourth gripping member to move into a position against the peripheral portion of an inner surface of the existing wallboard.

30. A wallboard clip for securing a patch wallboard to an existing wallboard, said wallboard clip comprising:

a body member having opposing first and second surfaces defining a thickness of about 0.01 to about ⅛ inch and first and second ends defining a length of from about ⅜ to 1 inch;

a first gripping member coupled to a first surface at a first end of said body member, said first gripping member having a thickness of about 0.01 to about ⅜ inch;

a triangular shaped member having three surfaces, a first surface of said triangular shaped member being coupled to said second end of said body, a first portion of said first surface of said triangular shaped member opposing said first gripping member defining a second gripping member, opposing surfaces of said first and second gripping members being disposed about 0.25 to about 1 inch apart, a third gripping member coupled to said second surface of said body member at said first end of said body member; and a second portion of said first surface of said triangular shaped member opposing said third gripping member defining a fourth gripping member, said second portion of said first surface being coupled to said first portion of said first surface via said second and third surfaces of said triangular shaped member such that said fourth gripping member being movably coupled with respect to said second surface of said body member, said inner surfaces of said third and fourth gripping members being disposed about 0.25 to about 1 inch apart.

31. A wallboard clip according to claim 30, wherein said wallboard clip is formed from a strip of metal.

32. A method of making a wallboard clip for securing a patch wallboard to an existing wallboard to repair the existing wallboard, said method comprising;

a) providing a metal strip having opposing first and second ends, opposing first and second surfaces, and an axis along the length of said metal strip:

b) cutting said first end of said metal strip substantially in a direction of said axis to form first and third gripping members;

c) bending said first gripping member in a first direction to form at about a 90° angle or less in relation to said axis;

d) bending said third gripping member in a second direction substantially opposite to said first direction to form about a 90° angle or less in relation to said axis such that inner surfaces of said first and third gripping members form about a 180° angle or less, wherein a body member being defined by a portion of said metal strip contacting said first and second gripping members;

e) bending said metal strip about 90° in relation to said axis in said first direction at an end of said body member to provide a second gripping member;

f) bending said metal strip towards said axis at an end of said second gripping member to provide a support;

g) bending said metal strip at an end of said support towards said axis to provide a sliding surface which is constructed and arranged to contact and slide along an edge of an existing wallboard during installation of the patch wallboard into the existing wallboard; and h) bending said metal strip at an end of said sliding surface in said first direction thereby defining a fourth gripping member, wherein a distance between an inner surface of said first gripping member and an inner surface of said second gripping member is about the thickness of a patch wallboard such that said inner surfaces of said first and second gripping members are capable of capturing a peripheral portion of the inner and outer surfaces of the patch wallboard, wherein a distance between an inner surface of said fourth gripping member and an inner surface of said third gripping member is about the thickness of the existing wallboard such that the inner surfaces of the third and fourth gripping members are capable of capturing a peripheral portion of inner and outer surfaces of the existing wallboard when the patch wallboard is in a repaired position, and wherein said inner surfaces of said first and third gripping members are substantially on a common plane when said wallboard clip is securing the patch wallboard in a repaired position within the existing wallboard.

33. A method according to claim 32, wherein said steps b through d are conducted prior to said step e.

34. A method according to claim 32, wherein said steps e through h are conducted prior to steps b through d.

35. A method according to claim 32, wherein step h is conducted prior to step g and step g is conducted prior to step f.

36. A method according to claim 32, wherein said step e is conducted such that said inner surfaces of said first and third gripping members form an angle of about 1 to about to about 20° less than 180° to provide tension against peripheral portions of the patch wallboard and existing wallboard.

37. A method according to claim 32, wherein said step e is conducted such that said inner surfaces of said first and third gripping members form an angle of about 2 to about to about 10° less than 180° to provide tension against peripheral portions of the patch wallboard and existing wallboard.

38. A method according to claim 32, wherein said step h is conducted such that said inner surface of said fourth gripping member is substantially parallel to said inner surface of said second gripping member.

39. A method according to claim 32, further comprising the step of forming a barb on said inner surface of said second gripping member.

40. A method according to claim 32, wherein said step g is conducted such that said sliding surface is curved.

41. A method of making a wallboard clip for securing a patch wallboard to an existing wallboard to repair the existing wallboard, said method comprising:

a) providing a metal strip having opposing first and second ends, opposing first and second surfaces, and an axis along the length of said metal strip;

b) providing a die having at least a first outer surface and a second outer surface;

c) contacting said second end of said metal strip with said first outer surface of said die such that said first surface of said metal strip contacts said first outer surface of said die;

d) bending said metal strip in a first circular direction around said die such that said first surface of said metal strip contacts a portion of said second surface of said metal strip located on said first surface of said die and overlaps said second surface of said metal strip at said second end of said metal strip, with a fourth gripping member being defined by said second end of said metal strip and said part of said metal strip shaped by said first surface of said die, a sliding surface being defined by said part of said metal strip shaped by said second surface of said die, and a second gripping member being defined by a part of said metal strip shaped by said first surface of said die and overlapping a part of said fourth griping member, said first and second outer surfaces of said die forming an acute angle such that said fourth gripping member and said sliding surface form an acute angle;

e) bending said metal strip in a second circular direction opposite to said first circular direction at an end of said second gripping member to form a body member;

f) cutting said first end of said metal strip substantially in a direction of said axis to form said first gripping member and said third gripping member;

g) bending said first gripping member towards said second gripping member at a location on said metal strip such that a distance between said inner surface of said first gripping member and an inner surface of said second gripping member is about the thickness of a patch wallboard such that said inner surfaces of said first and second gripping members are capable of capturing a peripheral portion of the inner and outer surfaces of the patch wallboard;

h) bending said third gripping member towards said fourth gripping member such that inner surfaces of said first and third gripping members form about a 180° angle or less and at a location on said metal strip such that a distance between an inner surface of said fourth gripping member and an inner surface of said third gripping member at a central location is about the thickness of the existing wallboard such that said inner surfaces of said third and fourth gripping members are capable of capturing a peripheral portion of inner and outer surfaces of the existing wallboard when the patch wallboard is in a repaired position, and said inner surfaces of said first and third gripping members are on substantially a common plane when said wallboard clip secures said patch wallboard in a repaired position within said existing wallboard; and i) removing said metal strip from said die.

42. A method according to claim 41, wherein said die is triangular shaped.

43. A method according to claim 41, wherein said first and second outer surfaces of said die are each substantially flat.

44. A method according to claim 41, wherein said second outer surface of said die is curved.

45. A method according to claim 41, wherein said step (e) is conducted at a location on said metal strip such that said sliding surface extends to both sides of said body member.

46. A method according to claim 41, wherein said steps (e), (g) and (h) are conducted such that said inner surfaces of said first and third gripping members are form an angle of about 1 to about 20° less than 180° to provide tension against peripheral portions of the patch wallboard and existing wallboard.

47. A method according to claim 41, wherein said steps (e), (g) and (h) are conducted such that said inner surfaces of said first and third gripping members are form an angle of about 2 to about 10° less than 180° to provide tension against peripheral portions of the patch wallboard and existing wallboard.

48. A method of repairing a hole in an existing wallboard using a wallboard clip comprising:

patch wallboard receiving structure constructed and arranged to receive a patch wallboard so as to capture a peripheral portion of inner and outer opposing surfaces of the patch wallboard;

an existing wallboard receiving member constructed and arranged to contact of peripheral portion of an outer surface of an existing wallboard to be repaired, said existing wallboard receiving member being coupled to said patch wallboard receiving structure such that the peripheral portion of said outer surface of the patch wallboard and the peripheral portion of the outer surface of the existing wallboard are arranged substantially in a common plane when the patch wallboard is in a repaired position within the existing wallboard; and locking structure spaced from and coupled to said wallboard receiving member, said locking structure being constructed and arranged to move between a insertion position, wherein a sliding surface of said locking structure is constructed and arranged to contact and slide against an end of the existing wallboard to place the patch wallboard in the repaired position, and a locking position, wherein said sliding surface of said locking structure is in a relaxed position permitting a securing surface of the locking structure to contact a peripheral portion of an inner surface of the existing wallboard that is opposed to the peripheral portion of the outer surface of the existing wallboard thereby capturing the peripheral portions of inner and outer surfaces of the existing wallboard when the patchboard is in the repaired position; said method comprising:

a) providing a patch wallboard having a surface area larger than a hole to be repaired in the existing wallboard;

b) tracing an outline of the patch wallboard on the existing wallboard which surrounds the hole to be repaired;

c) cutting out the trace on the existing wallboard;

d) inserting at least two of said wallboard clips onto the patch wallboard such that peripheral portions of the inner an outer surfaces of the patch wallboard are captured by said patch wallboard receiving structure; and e) inserting the patch wallboard containing the wallboard clips into the hole until the patch wallboard reaches a repaired position in which peripheral portions of the inner and outer surfaces of the existing wallboard are captured by said locking structure and said existing wallboard receiving structure.

49. A method according to claim 48 further comprising the step of plastering.

50. A method of repairing a hole in an existing wallboard using a wallboard clip comprising;

a) providing a patch wallboard sized to fit within a hole to be repaired in the existing wallboard;

b) inserting at least two wallboard clips onto the patch wallboard such that peripheral portions of the inner an outer surfaces of the patch wallboard are captured by the wallboard clip; and c) inserting the patch wallboard containing the wallboard clips into the hole until the patch wallboard reaches a repaired position in which peripheral portions of the inner and outer surfaces of the existing wallboard are captured by the wallboard clip.

51. A method according to claim 50, further comprising the steps of providing a patch wallboard having a surface area larger than an initial hole to be repaired in the existing wallboard; tracing an outline of the patch wallboard on the existing wallboard which surrounds the initial hole to be repaired; cutting out the trace on the existing wallboard to form a hole to be repaired in which the patch wallboard is sized to fit within.

52. A method according to claim 50, wherein said wallboard comprises drywall.

53. A method of accessing an interior of a hollow wall using wallboard clips, the method comprising:

cutting a hole in an existing wallboard, wherein a patch wallboard is defined by the cut;

removing the patch wallboard from the existing wallboard;

applying a plurality of wallboard clips to peripheral portions of the patch wallboard; wherein said wallboard clips are attached to the patch wallboard such that peripheral portions of the inner an outer surfaces of the patch wallboard are captured by the wallboard clips; and inserting the patch wallboard containing the wallboard clips into the hole until the patch wallboard reaches a repaired position in which peripheral portions of the inner and outer surfaces of the existing wallboard are captured by the wallboard clips.

54. A method according to claim 53, wherein said wallboard comprises drywall.

55. A method according to claim 53, wherein said drywall clips are formed from a metal.

56. A method of accessing an interior of a hollow wall using wallboard clips, the method comprising:

cutting a hole in an existing wallboard, wherein a patch wallboard is defined by the cut;

removing the patch wallboard from the existing wallboard;

applying a plurality of wallboard clips to peripheral portions of the patch wallboard;

inserting the patch wallboard containing wallboard clips into the hole such that said wallboard clips secure the patch wallboard within the existing wallboard, wherein said wallboard clip comprises:

a patch wallboard receiving structure constructed and arranged to receive a patch wallboard so as to capture a peripheral portion of inner and outer opposing surfaces of a patch wallboard;

an existing wallboard receiving member constructed and arranged to contact of peripheral portion of an outer surface of an existing wallboard to be repaired, said existing wallboard receiving member being coupled to said patch wallboard receiving structure such that the peripheral portion of the outer surface of the patch wallboard and the peripheral portion of the outer surface of the existing wallboard are arranged substantially in a common plane when the patch wallboard is in a repaired position within the existing wallboard; and locking structure spaced from and coupled to said wallboard receiving member, said locking structure being constructed and arranged to move between an insertion position, wherein a sliding surface of said locking structure is constructed and arranged to contact and slide against an end of the existing wallboard to place the patch wallboard in the repaired position, and a locking position, wherein said sliding surface of said locking structure is in a relaxed position permitting a securing surface of the locking structure to contact a peripheral portion of an inner surface of the existing wallboard that is opposed to the peripheral portion of the outer surface of the existing wallboard thereby capturing the peripheral portions of inner and outer surfaces of the existing wallboard when the patchboard is in the repaired position.

57. A patch wallboard for repairing a hole in existing wallboard comprising:

a patch wallboard; and a plurality of wallboard clips mounted around a periphery of said patch wallboard, said wallboard clips being constructed and arranged to capture inner and outer peripheral portions of an existing wallboard when said patch wallboard is in a repaired position within the existing wallboard.

58. A patch wallboard according to claim 57, wherein said wallboard clips are integrally formed with said patch wallboard.

59. A patch wallboard according to claim 58, wherein said wallboard clips comprise an existing wallboard receiving member and a locking structure.

60. A patch wallboard according to claim 59, wherein said locking structure comprises a fourth gripping member which is movably coupled with respect to the patch wallboard such that during installation of the patch wallboard into an existing wallboard said fourth gripping member is capable of moving into an installation position and once the patch wallboard is in a repaired position within the existing wallboard said fourth gripping member is capable of capturing a peripheral portion of an inner surface of said existing wallboard.

61. A wallboard clip for securing a patch wallboard to an existing wallboard, said wallboard clip comprising:

a body member;

first and second gripping members coupled to a first side of said body member, said first and second gripping members having opposed inner surfaces disposed about 0.25 to about 1 inch apart;

a third gripping member coupled to a second side of said body member opposing said first side of said body member, said third gripping member having an inner surface; and a fourth gripping member movably coupled with respect to said second side of said body member and having an inner surface opposing said inner surface of said third gripping member, said inner surfaces of said third and fourth gripping members being disposed about 0.25 to about 1 inch apart, wherein said first and second gripping members being spaced a different distance than said third and fourth gripping members.

62. A wallboard clip according to claim 61, wherein said first and second gripping members having opposed inner faces disposed about 0.5 inch apart and said inner surfaces of said third and fourth gripping members being disposed about ⅝ inch apart.

63. A wallboard clip according to claim 61, wherein said first and second gripping members having opposed inner faces disposed about ⅜ inch apart and said inner surfaces of said third and fourth gripping members being disposed about 0.5 inch apart.

* * * * *